US009723422B2

(12) United States Patent
Jensen et al.

(10) Patent No.: US 9,723,422 B2
(45) Date of Patent: Aug. 1, 2017

(54) MULTI-MICROPHONE METHOD FOR ESTIMATION OF TARGET AND NOISE SPECTRAL VARIANCES FOR SPEECH DEGRADED BY REVERBERATION AND OPTIONALLY ADDITIVE NOISE

(71) Applicant: Oticon A/S, Smørum (DK)

(72) Inventors: Jesper Jensen, Smørum (DK); Adam Kuklasiński, Smørum (DK)

(73) Assignee: OTICON A/S, Smørum (DK)

( * ) Notice: Subject to any disclaimer, the term of this patent is extended or adjusted under 35 U.S.C. 154(b) by 185 days.

(21) Appl. No.: 14/640,664

(22) Filed: Mar. 6, 2015

(65) Prior Publication Data

US 2015/0256956 A1 Sep. 10, 2015

(30) Foreign Application Priority Data

Mar. 7, 2014 (EP) ..... 14158321
Dec. 10, 2014 (EP) ..... 14197100

(51) Int. Cl.
*H04R 25/00* (2006.01)
*H04R 29/00* (2006.01)
(Continued)

(52) U.S. Cl.
CPC ..... *H04R 29/005* (2013.01); *G10L 21/0208* (2013.01); *H04R 25/30* (2013.01);
(Continued)

(58) Field of Classification Search
CPC ..... H04R 3/005
See application file for complete search history.

(56) References Cited

U.S. PATENT DOCUMENTS

2009/0248403 A1 10/2009 Kinoshita et al.
2010/0246844 A1 9/2010 Wolff et al.
(Continued)

FOREIGN PATENT DOCUMENTS

EP 2 701 145 A1 2/2014
WO WO 2012/159217 A1 11/2012

OTHER PUBLICATIONS

Abramson et al., "Dual-Microphone Speech Dereverberation Using GARCH Modeling," IEEE International Conference on Acoustics, Speech and Signal Processing, Piscataway, NJ, USA, Mar. 31, 2008, XP031251614, pp. 4565-4568.
(Continued)

*Primary Examiner* — Joseph Saunders, Jr.
(74) *Attorney, Agent, or Firm* — Birch, Stewart, Kolasch & Birch, LLP

(57) ABSTRACT

The application relates to an audio processing system and a method of processing a noisy (e.g. reverberant) signal comprising first (v) and optionally second (w) noise signal components and a target signal component (x), the method comprising a) Providing or receiving a time-frequency representation $Y_i(k,m)$ of a noisy audio signal $y_i$ at an $i^{th}$ input unit, i=1, 2, . . . , M, where M≥2; b) Providing (e.g. predefined spatial) characteristics of said target signal component and said noise signal component(s); and c) Estimating spectral variances or scaled versions thereof $\lambda_V$, $\lambda_X$ of said first noise signal component v (representing reverberation) and said target signal component x, respectively, said estimates of $\lambda_V$ and $\lambda_X$ being jointly optimal in maximum likelihood sense, based on the statistical assumptions that a) the time-frequency representations $Y_i(k,m)$, $X_i(k,m)$, and $V_i(k,m)$ (and $W_i(k,m)$) of respective signals $y_i(n)$, and signal components $x_i$, and $v_i$ (and $w_i$) are zero-mean, complex-valued Gaussian distributed, b) that each of them are statistically independent across time m and frequency k, and c)
(Continued)

that $X_i(k,m)$ and $V_i(k,m)$ (and $W_i(k,m)$) are uncorrelated. An advantage of the invention is that it provides the basis for an improved intelligibility of an input speech signal. The invention may e.g. be used for hearing assistance devices, e.g. hearing aids.

19 Claims, 8 Drawing Sheets

(51) Int. Cl.

| | |
|---|---|
| ***G10L 21/0208*** | (2013.01) |
| *G10L 21/0216* | (2013.01) |
| *G10L 21/0232* | (2013.01) |
| *H04R 3/00* | (2006.01) |

(52) U.S. Cl.
CPC *G10L 21/0232* (2013.01); *G10L 2021/02082* (2013.01); *G10L 2021/02166* (2013.01); *H04R 3/005* (2013.01); *H04R 25/407* (2013.01)

(56) References Cited

U.S. PATENT DOCUMENTS

| | | | |
|---|---|---|---|
| 2011/0044462 | A1 | 2/2011 | Yoshioka et al. |
| 2013/0343571 | A1 | 12/2013 | Rayala et al. |

OTHER PUBLICATIONS

Braun et al., "Dereverberation in Noisy Environments Using Reference Signals and a Maximum Likelihood Estimator", 21st European Signal Processing Conference, EUSIPCO, 2013, pp. 1-5.

Ephraim et al., "Speech Enhancement Using a Minimum Mean-Square Error Short-Time Spectral Amplitude Estimator", IEEE Transactions on Acoustics, Speech, and Signal Processing, vol. ASSP-32, No. 6, Dec. 1984, pp. 1109-1121.

Hioka et al., "Estimating Direct-to-Reverberant Energy Ratio Using D/R Spatial Correlation Matrix Model", IEEE Transactions on Audio, Speech, and Language Processing, vol. 19, No. 8, Nov. 2011, pp. 2374-2384.

Kjems et al., "Maximum Likelihood Based Noise Covariance Matrix Estimation for Multi-Microphone Speech Enhancement", 20th European Signal Processing Conference (EUSIPCO 2012), Aug. 27-31, 2012, Bucharest, Romania, pp. 295-299.

Shimizu et al., "Isotropic Noise Suppression in the Power Spectrum Domain by Symmetric Microphone Arrays", 2007 IEEE Workshop on Applications of Signal Processing to Audio and Acoustics, Oct. 21-24, 2007, New Paltz, NY, pp. 54-57.

Ye et al., "Maximum Likelihood DOA Estimation and Asymptotic Cramér-Rao Bounds for Additive Unknown Colored Noise", IEEE Transactions on Signal Processings, vol. 43, No. 4, Apr. 1995, pp. 938-949.

MULTI-MICROPHONE METHOD FOR ESTIMATION OF TARGET AND NOISE SPECTRAL VARIANCES FOR SPEECH DEGRADED BY REVERBERATION AND OPTIONALLY ADDITIVE NOISE

TECHNICAL FIELD

The present application relates to a method of audio processing and an audio processing system for estimating spectral variances of respective target and noise (e.g. reverberant) signal components in a noisy (e.g. reverberant) signal, and to the use of the audio processing system. The application further relates to a data processing system comprising a processor and program code means for causing the processor to perform at least some of the steps of the method.

Embodiments of the disclosure may e.g. be useful in applications such as hearing assistance devices, e.g. hearing aids, headsets, ear phones, active ear protection systems, handsfree telephone systems, mobile telephones, or in teleconferencing systems, public address systems, karaoke systems, classroom amplification systems, etc.

BACKGROUND

The following account of the prior art relates to one of the areas of application of the present application, hearing aids.

It is known that hearing aid users face problems in understanding speech in reverberant environments, e.g., rooms with hard walls, churches, lecture rooms, etc. Although this user problem is well-known, there appears to exist only few hearing aid signal processing algorithms related to this problem.

US2009248403A describes a multi-microphone system and a linear prediction model eliminate reverberation. WO12159217A1 deals with a technique to improve speech intelligibility in reverberant environments or in other environments with diffuse sound in addition to direct sound. US2013343571A1 describes a microphone array processing system including adaptive beamforming and postfiltering configured to reduce noise components (e.g. reverberation) remaining from the beamforming. US2010246844A1 deals with a method of determining a signal component for reducing noise (e.g. reverberation) in an input signal. [Braun&Habets; 2013] deals with de-reverberation in noisy environments. [Shimitzu et al.; 2007] deal with isotropic noise suppression in the power spectrum domain by symmetric microphone arrays. The described method determines a spectral variance of a target signal based on a free-field assumption wherein the covariance matrix is circular symmetric.

SUMMARY

A reverberant and noisy speech signal impinging on a microphone may be divided into two, optionally three, parts:

a) The direct sound of the speech signal and the first few reflections (including roughly 50 ms of the impulse response after the direct sound),
b) The late-reverberation signal, that is, reflected speech signal components arriving later than roughly 50 ms of the direct sound, and optionally
c) An additive noise component.

It is assumed that the signal power (specifically the inter input transducer covariance matrix, see later) of the additive noise is known. Examples of additive noise in the sense of the present disclosure are microphone noise, motor noise (e.g. in a car or airplane), large crowd noise (e.g. so-called 'cocktail party noise').

It is well-known that, roughly speaking, part a) is beneficial for speech intelligibility, whereas parts b) and c) reduce intelligibility both for normal hearing and hearing impaired listeners.

The main goal of the present disclosure is to estimate the signal power as a function of time and frequency of each signal components a) and b) online (i.e. dynamically, during use of an audio processing device, e.g. a hearing assistance device), using two or more microphones. The proposed method is independent of microphone locations and number, that is, it can work when two microphones are available locally in a hearing aid, but it can also work when external microphone signals, e.g., from the opposite hearing aid or external devices, are available.

As outlined in more detail below, the main idea has several potential usages, i) for selecting an appropriate processing method in the hearing aid,
ii) for informing the user to which extent the hearing aid is able to operate appropriately in the given environment,
iii) for processing the signal to reduce the reverberation and optionally additional noise,
iv) etc.

The disclosure is based on the fact that the spatial characteristics of a typical target speech signal and of a reverberant sound field are quite different. Specifically, the proposed method exploits that a reverberant sound field may be modelled as being approximately isotropic, that is, for a given frequency, the reverberant signal power originating from any direction is (approximately) the same. The direct part of a target speech signal, on the other hand, is confined to roughly one direction.

In an embodiment of the present disclosure, an algorithm for speech de-reverberation is proposed, which allows for joint estimation of the target and interference spectral variances also during speech presence. The algorithm uses Maximum Likelihood Estimation (MLE) method, cf. e.g. [Ye&DeGroat; 1995]. We assume an isotropic spatial distribution of the reverberation and a known speaker direction. Therefore, the structure of the inter-microphone covariance matrices of the speech and reverberation is known and only the time-varying spectral variances (scaling factors of these matrices) are estimated in the MLE framework.

It is relevant to mention, that the algorithm proposed in the present disclosure is also applicable to target signals other than speech and to interference types other than reverberation. However, it is a prerequisite that the spatial distribution of the interference is isotropic or is otherwise known or estimated.

An object of the present application is to provide a scheme for estimating the signal power as a function of time and frequency of a reverberant part of a reverberant speech signal. A further object of embodiments of the application is to improve speech intelligibility in noisy situations (over existing solutions). A still further object of embodiments of the application is to improve sound quality in noisy situations.

Objects of the application are achieved by the invention described in the accompanying claims and as described in the following.

A Method of Processing a Noisy Audio Signal:

In an aspect of the present application, an object of the application is achieved by a method of processing a noisy audio signal y(n) comprising a target signal component x(n) and a first noise signal component v(n), n representing time, the method comprising a) Providing or receiving a time-frequency representation $Y_i(k,m)$ of the noisy audio signal $y_i(n)$ at an $i^{th}$ input unit, i=1, 2, . . . , M, where M is larger than or equal to two, in a number of frequency bands and a number of time instances, k being a frequency band index and m being a time index;

b) Providing characteristics of said target signal component and said first noise signal component; and c) Estimating spectral variances or scaled versions thereof $\lambda_V$, $\lambda_X$ of said first noise signal component v and said target signal component x, respectively, as a function of frequency index k and time index m, said estimates of $\lambda_V$ and $\lambda_X$ being jointly optimal in maximum likelihood sense, based on the statistical assumptions that a) the time-frequency representations $Y_i(k,m)$, $X_i(k,m)$, and $V_i(k,m)$ of respective signals $y_i(n)$, and signal components $x_i(n)$, and $v_i(n)$ are zero-mean, complex-valued Gaussian distributed, b) that each of them are statistically independent across time m and frequency k, and c) that $X_i(k,m)$ and $V_i(k,m)$ are uncorrelated.

An advantage of the present disclosure is that it provides the basis for an improved intelligibility of an input speech signal. A further advantage of the present disclosure is that the resulting estimation of spectral variances of signal components of the noisy audio signal is independent of number and/or location of the input units.

In general, the 'characteristics of the noise signal component' (be it 'first' or 'second' or other) is taken to mean characteristics of the noise signal component with respect to space, frequency and/or time (e.g. relating to variation of signal energy over time, frequency and space). Such characteristics may in general e.g. relate to noise power spectral density and its variation across time, measured at different spatial positions (e.g. at the input units, e.g. microphones). Additionally or alternatively, it may relate to the directional or spatial distribution of noise energy, i.e. e.g. to the amount of noise energy impinging on an input unit as a function of direction (for a given frequency and time instant). In an important embodiment, the method deals with 'spatial characteristics' of additive noise. In an embodiment, the 'characteristics of the noise signal component' is taken to mean the 'spatial characteristics' or 'spatial fingerprint'. In an embodiment, the 'spatial characteristics' or 'spatial fingerprint' of the noise signal component is defined by the inter input unit (e.g. the inter microphone) noise covariance matrix.

The present method is in a preferred embodiment based on spatial filtering. In an embodiment, the characteristics of the target signal component and the first noise signal component are spatial characteristics.

The term 'scaled versions thereof' is taken to mean 'multiplied by a real number' (different from zero).

In an embodiment, the noise signal component is defined by said assumption of the (e.g. spatial) characteristics. In other words, the components of the noisy audio signal that fulfill said assumption is considered to be included in (such as constitute) the noise. It is generally assumed that the target signal component $x_i(n)$ and the noise signal component(s) (e.g. $v_i(n)$) at input unit i are uncorrelated.

The (possibly normalized) spectral variances (or scaled versions thereof) $\lambda_V$, $\lambda_X$ are determined by a maximum likelihood method based on a statistical model. In an embodiment, the statistical model of the maximum likelihood method used for determining the spectral variances $\lambda_V$, $\lambda_X$ of said first noise signal component v and said target signal component x, respectively, is that the time-frequency representations $Y_i(k,m)$, $X_i(k,m)$, and $V_i(k,m)$ of respective signals yi(n), and signal components $x_i(n)$, and $v_i(n)$ are zero-mean, complex-valued Gaussian distributed, that each of them are statistically independent across time m and frequency k, and that $X_i(k,m)$ and $V_i(k,m)$ are uncorrelated. In an embodiment, the maximum likelihood estimation of $\lambda_V$ and $\lambda_X$ is exclusively based on the mentioned assumptions.

In the present context, the term 'jointly optimal' is intended to emphasize that both of the spectral variance $\lambda_V$, $\lambda_X$ are estimated in the same Maximum Likelihood estimation process.

The method is generally based on an assumption of the characteristics of the noise signal component(s). In an embodiment, the method is further based on an assumption of the characteristics of the target signal component. In an embodiment, characteristics of the target signal component comprises a particular spatial arrangement of the input units compared to a direction to the target signal. In an embodiment, characteristics of the target signal component comprises its time variation (e.g. its modulation), its frequency content (e.g. its power level over frequency), etc.

In an embodiment, the noisy audio signal $y_i(n)$ comprises a reverberation signal component $v_i(n)$.

In an embodiment, the noisy audio signal $y_i(n)$ comprises a reverberant signal comprising a target signal component and a reverberation signal component. In an embodiment, the reverberation signal component is a dominant part of the (first) noise signal component v(n). In an embodiment, only the reverberation signal component of the (first) noise signal component $v_i(n)$ is considered. In an embodiment, the reverberation signal component is equal to the (first) noise signal component $v_i(n)$.

In an embodiment, the target signal component comprises or constitutes a target speech signal component $x_i(n)$. In an embodiment, the noisy audio signal $y_i(n)$ is a noisy target speech signal comprising a target speech signal component $x_i(n)$ and a first noise signal component $v_i(n)$, in other words $y_i(n)=x_i(n)+v_i(n)$, i=1, 2, . . . , M. In an embodiment, the noisy audio signal is a reverberant target speech signal $y_i(n)$ comprising a target speech signal component $x_i(n)$ and a reverberation signal component $v_i(n)$.

In an embodiment, an assumption of the characteristics of the first noise signal component is that said first noise signal component $v_i(n)$ is essentially spatially isotropic. The term 'the noise signal component is essentially spatially isotropic' is taken to mean that the noise signal component arrives at a specific input unit 'uniformly from all possible directions', i.e. is 'spherically isotropic' (e.g. due to background noise in a large production facility, 'cocktail party noise', (late) reflections from walls of a room, etc.). In other words, for a given frequency, the noise signal power originating from any direction is the same. In an embodiment, 'spatially isotropic' is limited to 'cylindrically isotropic'.

In an embodiment, a target signal propagated from a target source to a listener (an input unit)—when it arrives at the listener—is divided into a first part and a second part. Typically, the first part—comprising directly (un-reflected) sound components and first few reflections—is beneficial for speech intelligibility, whereas the second part comprising later reflections reduce speech intelligibility (both for normal hearing and hearing impaired listeners). In an embodiment, the first part is considered as the target signal component $x_i$, whereas the second part $v_i$ is taken as a noise (reverberation) signal component.

In an embodiment, the first noise signal component $v_i(n)$ is constituted by late reverberations. The term 'late reverberations' is in the present context taken to mean 'later reflections' comprising signal components of a sound that arrive at a given input unit (e.g. the $i^{th}$) a predefined time $\Delta t_{pd}$ after the first peak of the impulse response has arrived at the input unit in question (see e.g. FIG. 1). In an embodiment, the predefined time $\Delta t_{pd}$ is larger than or equal to 30 ms, such as larger than or equal to 40 ms, e.g. larger than or equal to 50 ms. In an embodiment, such 'late reverberations' include sound components that have been subject to three or more reflections from surfaces (e.g. walls) in the environment. The 'late reverberations' are constituted by sound components that (due to a longer acoustic travelling path between source and receiving device caused by reflections) arrive later (more than $\Delta t_{pd}$ later) at the receiving device (i.e. the input units) than the direct sound (the direct sound being constituted by sound components that have been subject to essentially no reflections).

In an embodiment, the noisy audio signal y(n) comprises a target signal component x(n), a first noise signal component being a reverberation signal component v(n), and a second noise signal component being an additive noise signal component w(n), and wherein the method comprises providing characteristics of said second noise signal component. In other words, an additional (known) noise source is taken into account in the determination of the spectral variances $\lambda_X$ and $\lambda_V$ of the target signal component x and the (first) noise signal component v, respectively.

In an embodiment, the noisy audio signal $y_i(n)$ at the $i^{th}$ input unit comprises a target signal component $x_i(n)$, a reverberation signal component $v_i(n)$, and an additive noise component $w_i(n)$.

In an embodiment, the characteristics of the second noise signal component are spatial characteristics. In an embodiment, the characteristics of the second noise signal component w is represented by a predetermined inter input unit covariance matrix $C_W$ of the additive noise.

In an embodiment, the method comprises determining separate characteristics (e.g. spatial fingerprints) of the target signal and of the noise signal components. The term 'spatial fingerprint' is intended to mean the total collection of input unit (e.g. microphone) signals for a specific acoustic scene (including 3D-locations of acoustic objects, e.g. acoustic reflectors, etc.). The term 'spatial fingerprint' is e.g. intended to include the (e.g. three dimensional) geometrical (spatial) characteristics of the signal source(s) in question, including characteristics of its propagation. In an embodiment, the 'spatial fingerprint' represents an acoustic situation where the noise signal (e.g. the first noise signal) is isotropic. In an embodiment, the 'spatial fingerprint' is represented by a (time varying) inter input unit covariance matrix. In an embodiment, the spatial fingerprint of the target signal is essentially confined to one direction. The separation of the problem in spatial characteristics of target and noise signals is advantageous, because if sound sources are separated in space they may be separated via spatial filtering/beamforming, even if they overlap in time and frequency. Thereby simplifications can be made, if individual characteristics of the target and/or noise signal(s) are known (i.e. prior knowledge can be built into the system).

In an embodiment, the characteristics (e.g. spatial fingerprint) of the target signal is represented by a look vector $\underline{d}(k,m)$ whose elements (i=1, 2, . . . , M) define the (frequency and time dependent) absolute acoustic transfer function from a target signal source to each of the M input units, or the relative acoustic transfer function from the $i^{th}$ input unit to a reference input unit. The look vector $\underline{d}(k,m)$ is an M-dimensional vector, the $i^{th}$ element $d_i(k,m)$ defining an acoustic transfer function from the target signal source to the $i^{th}$ input unit (e.g. a microphone). Alternatively, the $i^{th}$ element $d_i(k,m)$ define the relative acoustic transfer function from the $i^{th}$ input unit to a reference input unit (ref). The vector element $d_i(k,m)$ is typically a complex number for a specific frequency (k) and time unit (m). In an embodiment, the look vector is predetermined, e.g. measured (or theoretically determined) in an off-line procedure or estimated in advance of or during use. In an embodiment, the look vector is estimated in an off-line calibration procedure. This can e.g. be relevant, if the target source is at a fixed location (or direction) compared to the input unit(s), if e.g. the target source is (assumed to be) in a particular location (or direction) relative to (e.g. in front of) the user (i.e. relative to the device (worn or carried by the user) wherein the input units are located).

In an embodiment, the power spectral density originating from a given target source is measured at a reference input unit (e.g. a reference microphone). In an embodiment, the power spectral density originating from noise (with a predetermined covariance structure, e.g. isotropically distributed noise) is measured at a reference input unit (e.g. a reference microphone). The measurements are e.g. carried out in an off-line procedure (before the audio processing system is taken into normal use) and results thereof stored in (a memory of) the audio processing system. The measurements are preferably carried out with the audio processing system in 'a normal local environment', e.g. for an audio processing system, such as a hearing assistance system, comprising one or more devices located at a body, e.g. the head, of a human being. Thereby the influence of the local environment can be taken into account, when measuring the power spectra ('spatial fingerprints') of the target and noise signal components.

In an embodiment, at least one of the M input units comprises a microphone. In an embodiment, a majority, such as all, of the M input units comprises a microphone. In an embodiment, M is equal to two. In an embodiment, M is larger than or equal to three. In an embodiment, a first one of the M input units is located in an audio processing device (e.g. a hearing aid device). In an embodiment, at least one of the other M input units is located a distance to the first input unit that is larger than a maximum outer dimension of the audio processing device where the first input unit is located. In an embodiment, a first of the M input units is located in a first audio processing device and a second of the M input units is located in another device, the audio processing device and the other device being configured to establish a communication link between them. In an embodiment, at least one of the input units comprises an electrode, e.g. an electrode for picking up a brain wave signal, e.g. an EEG-electrode for picking up a signal associated with an audio signal related to the present acoustic scene where the input units are located. In an embodiment, at least one of the input units comprises a wireless receiver for receiving an audio signal related to the present acoustic scene where the input units are located. In an embodiment, at least one of the input units comprises a video camera, for picking up images related to the present acoustic scene where the input units are located. In an embodiment, at least one of the input units comprises a vibration sensor (e.g. comprising an accelerometer) for picking up vibrations from a body, e.g. a bone of a human being (e.g. a skull bone).

In an embodiment, the electric input signals from the input units (i=1, 2, . . . , M) are normalized. This has the advantage that the signal contents of the individual signals can be readily compared. In an embodiment, the audio processing device comprises a normalization filter operationally connected to an electrical input, the normalization filter being configured to have a transfer function $H_N(f)$, which makes the source providing the electric input signal in question comparable and interchangeable with the other sources. The normalization filter is preferably configured to allow a direct comparison of the input signals and input signal components $Y_i(k,m)$ (TF-units or bins). A normalization can e.g. compensate for a constant level difference between two electric input signals (e.g. due to the location of the two source input transducers providing the input signals relative to the current sound source(s)). Further, a normalization can e.g. allow a comparison of electric input signals from different types of input units, e.g. a microphone, a mechanical vibration sensor, an electrode for picking up brain waves, or a camera for lip-reading a user's mouth, while speaking, etc. In an embodiment, the normalization filter comprises an adaptive filter.

In an embodiment, a method of normalizing M electric input signals comprises a) Select a reference source input signal (e.g. the signal assumed to be most reliable), e.g. signal $Y_1$, b) for each of the other source input signals $Y_i$, i=2, . . . , M, calculate the difference in magnitude over frequency to the reference (e.g. for a common time period of the signals and/or for respective signals averaged over a certain time), and c) scale each source by multiplication with a (possibly complex) correction value.

In an embodiment, the characteristics (e.g. spatial fingerprint) of the (first) noise signal v is represented by the noise signal inter-input unit covariance matrix $C_V$. In an embodiment, the (noise) inter-input unit covariance matrix is predetermined, e.g. measured (or theoretically determined) in an off-line procedure or estimated in advance of or during use. In an embodiment, the characteristics (e.g. spatial fingerprint) of the (first) noise signal v is represented by an estimate of the inter-input unit covariance matrix $C_V$ of the noise impinging on the input units, or a scaled version thereof. In an embodiment, inter-input covariance matrix $C_V$ of the noise (e.g. late reverberations) is determined as the covariance arising from an isotropic field. This can be written as $C_V(k,m)=\lambda_V(k,m)\cdot C_{iso}(k,m)$, where $\lambda_V(k,m)$ is the spectral variance (or a scaled version thereof) of the (first) noise signal component v, and $C_{iso}(k,m)$ is the covariance matrix for an isotropic (noise) field (or a scaled version thereof). Preferably, possible scaled versions $\lambda_v'$ of the spectral variance $\lambda_v'$ ($\lambda_v'=k_1\cdot\lambda_v$, and $k_1$ is a real number different from 0), and scaled versions $C_{iso}'$ of the covariance matrix $C_{iso}$, for an isotropic field ($C_{iso}'=k_2\cdot C_{iso}$, and $k_2$ is a real number different from 0) fulfil the relation $\lambda_v'\cdot C_{iso}'=\lambda_v\cdot C_{iso}$. (i.e. $k_1=1/k_2$). The matrix $C_{iso}(k,m)$ can e.g. be estimated in an off-line procedure. In an embodiment, $C_{iso}(k,m)$ is estimated by exposing an audio processing device or system comprising the input units (e.g. a hearing aid) mounted on a dummy head to a reverberant sound field (e.g. approximated as an isotropic field), and measuring the resulting inter-input unit (e.g. inter microphone) covariance matrix ($\sim C_{iso}(k,m)$). [Kjems&Jensen; 2012] describe various aspects of noise covariance matrix estimation in a multi-microphone speech configuration.

The target signal component and the noise signal component(s) are generally assumed to be un-correlated. In such case, the inter-input unit covariance matrix $C_Y$ of the noisy audio signal y is a sum of the inter-input unit covariance matrix $C_X$ of the target signal x and the inter-input unit covariance matrix $C_V$ of the first, and optionally second $C_w$, noise signal(s).

In an embodiment, the characteristics of the target signal component and the first noise signal component are defined by the look vector $\underline{d}(k,m)$ (or inter input covariance matrix $\underline{d}\cdot\underline{d}^H$) and inter input unit covariance matrix $C_V$ ($\sim C_{iso}(k,m)$), respectively.

In an embodiment, the inter-input unit covariance matrix $C_X$ of the (clean) target signal x is determined by the look vector $\underline{d}$ and the spectral variance $\lambda_X$ of the target signal x. This can be written as $C_X(k,m)=\lambda_X(k,m)\cdot\underline{d}(k,m)\cdot\underline{d}(k,m)^H$, where $\lambda_X(k,m)$ is the spectral variance of the target signal component x, and $\underline{d}(k,m)$ is the (possibly normalized) look vector for the input unit setup in question (i=1, 2, . . . , M), and H denotes Hermitian transposition. The spectral variance $\lambda_X(k,m)$ is a real (non-negative) number, the look vector $\underline{d}(k,m)\cdot$ is a vector of dimension (or size) M (=the number of input units), and the covariance matrix $C_X$ is of the order (or degree) M×M.

Preferably, the inter-input unit covariance matrices are estimated by a maximum likelihood based method (cf. e.g. [Kjems&Jensen; 2012]).

In an embodiment, estimation of the spectral variance $\lambda_X(k,m)$ of the target signal x (or a scaled version thereof) comprises using a beamformer to provide filter weights w(k,m), e.g. MVDR beamformer. MVDR is an abbreviation of Minimum Variance Distortion-less Response, Distortion-less indicating that the target direction is left unaffected; Minimum Variance: indicating that signals from any other direction than the target direction is maximally suppressed).

In an embodiment, the MVDR beamformer is based on a look vector $\underline{d}(k,m)$ and a predetermined covariance matrix $C_{iso}(k,m)$ for an isotropic field, said MVDR filtering method providing filter weights $w_{mvdr}(k,m)$. The covariance matrix $C_{iso}(k,m)$ is determined in an off-line procedure. The look vector $\underline{d}(k,m)$ can be determined in an off-line procedure, or, alternatively, dynamically during use of an audio processing device or system executing the method. In an embodiment, the method comprises estimating whether or not a target (e.g. speech) signal is present or dominating at a given point in time (e.g. using a voice activity detector). In an embodiment, the spatial fingerprint of the target signal, e.g. a look vector, is updated when it is estimated that the target signal is present or dominant.

In an embodiment, the method comprises making an estimate of the inter input unit covariance matrix $\hat{C}_Y(k,m)$ of the noisy audio signal based on a number D of observations.

In an embodiment, maximum-likelihood estimates of the spectral variances $\lambda_X(k,m)$ and $\lambda_V(k,m)$ of the target signal component x and the noise signal component v, respectively, are derived from estimates of the inter-input unit covariance matrices $C_Y(k,m)$, $C_X(k,m)$, $C_V(k,m)$, and optionally $C_w(k,m)$, and the look vector $\underline{d}(k,m)$. In an embodiment, the look vector $\underline{d}(k,m)$ and the noise covariance matrix $C_V(k,m)$ and optionally $C_W(k,m)$ are determined in an off-line procedure.

In an embodiment, a multi-input unit beamformer is used to spatially attenuate background noise sources. Many beamformer variants can be found in the literature, e.g. the minimum variance distortionless response (MVDR) beamformer is or the generalized sidelobe canceller (GSC) beamformer.

In an embodiment, the method further comprises applying beamforming to the noisy audio signal y(n) providing a beamformed signal and single channel post filtering to the beamformed signal to suppress noise signal components from a direction of the target signal and to provide a resulting noise reduced signal. In an embodiment, the method comprises applying target cancelling spatial filtering to the time-frequency representation $Y_i(k,m)$ of the noisy audio signal $y_i(n)$ at an $i^{th}$ input unit, i=1, 2, . . . , M, to provide a target-cancelled signal wherein signal components from a direction of the target signal component are attenuated, while leaving signal components from other directions un-attenuated. An aim of the single channel post filtering process is to suppress noise components from the target direction (which has not been suppressed by the spatial filtering process (e.g. an MVDR beamforming process). It is a further aim to suppress noise components in situations when the target signal is present or dominant as well as when the target signal is absent. In an embodiment, the single channel post filtering process is based on an estimate of a target signal to noise ratio for each time-frequency tile (m,k). In an embodiment, the estimate of the target signal to noise ratio for each time-frequency tile (m,k) is determined from the beamformed signal and the target-cancelled signal. In an embodiment, the beamforming applied to the noisy audio signal y(n) is based on an MVDR procedure. In an embodiment, the noise reduced signal is de-reverberated.

In an embodiment, gain values $g_{sc}(k,m)$ applied to the beamformed signal in the single channel post filtering process is based on estimates of the spectral variances $\lambda_X(k,m)$ and $\lambda_V(k,m)$ of the target signal component x and the (first) noise signal component v, respectively. Alternatively, gain values $g_{sc}(k,m)$ can be determined by $|Y(k,m)|^2$, $\lambda_X(k,m)$ and $\lambda_V(k,m)$, or a combination of two or more of these parameters.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application. In addition to being stored on a tangible medium such as diskettes, CD-ROM-, DVD-, or hard disk media, or any other machine readable medium, and used when read directly from such tangible media, the computer program can also be transmitted via a transmission medium such as a wired or wireless link or a network, e.g. the Internet, and loaded into a data processing system for being executed at a location different from that of the tangible medium.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

An Audio Processing System:

In an aspect, an audio processing system for processing a noisy audio signal y comprising a target signal component x and a first noise signal component v is furthermore provided by the present application. The audio processing system comprises a) a multitude M of input units adapted to provide or to receive a time-frequency representation $Y_i(k,m)$ of the noisy audio signal $y_i(n)$ at an $i^{th}$ input unit, i=1, 2, . . . , M, where M is larger than or equal to two, in a number of frequency bands and a number of time instances, k being a frequency band index and m being a time index;

b) a look vector d(k,m) for the target signal component and an inter-input unit covariance matrix $C_v(k,m)$ for the first noise signal component, or scaled versions thereof;

c) a covariance estimation unit for estimating an inter input unit covariance matrix $\hat{C}_Y(k,m)$, or a scaled version thereof, of the noisy audio signal based on the time-frequency representation $Y_i(k,m)$ of the noisy audio signals $y_i(n)$; and d) a spectral variance estimation unit for estimating spectral variances $\lambda_X(k,m)$ and $\lambda_V(k,m)$ or scaled_versions thereof of the target signal component x and the noise signal component v, respectively, based on said look vector d(k,m), said inter-input unit covariance matrix $C_v(k,m)$, and the covariance matrix $\hat{C}_Y(k,m)$, or a scaled version thereof, of the noisy audio signal, wherein said estimates of $\lambda_V$ and $\lambda_X$ are jointly optimal in maximum likelihood sense, based on the statistical assumptions that a) the time-frequency representations $Y_i(k,m)$, $X_i(k,m)$, and $V_i(k,m)$ of respective signals $y_i(n)$, and signal components $x_i(n)$, and $v_i(n)$ are zero-mean, complex-valued Gaussian distributed, b) that each of them are statistically independent across time m and frequency k, and c) that $X_i(k,m)$ and $V_i(k,m)$ are uncorrelated.

It is intended that some or all of the process features of the method described above, in the 'detailed description of embodiments' or in the claims can be combined with embodiments of the system, when appropriately substituted by a corresponding structural feature and vice versa. Embodiments of the system have the same advantages as the corresponding method.

In an embodiment, the noisy audio signal y(n) comprises a target signal component x(n), a first noise signal component being a reverberation signal component v(n), and a second noise signal component being an additive noise signal component w(n), and wherein the audio processing system comprises a predetermined inter input unit covariance matrix $C_W$ of the additive noise.

Preferably, the covariance matrix $C_w(k,m)$ for the second noise signal component (or a scaled version thereof) is predefined and e.g. stored in a memory of the audio processing system accessible to the spectral variance estimation unit.

In an embodiment, the spectral variance estimation unit is configured to estimate spectral variances $\lambda_X(k,m)$ and $\lambda_V(k,m)$ or scaled versions thereof of the target signal component x and the first noise signal component v, respectively, based on said look vector d(k,m), said inter-input unit covariance matrix $C_v(k,m)$ of the first noise component, said inter-input unit covariance matrix $C_W(k,m)$ of the second noise component, and said covariance matrix $\hat{C}_Y(k,m)$ of the noisy audio signal, or scaled versions thereof, wherein said estimates of $\lambda_V$ and $\lambda_X$ are jointly optimal in maximum likelihood sense, based on the statistical assumptions that a) the time-frequency representations $Y_i(k,m)$, $X_i(k,m)$, $V_i(k,m)$, and $W_i(k,m)$ of respective signals $y_i(n)$, and signal components $x_i(n)$, $v_i(n)$, $w_i(n)$ are zero-mean, complex-valued Gaussian distributed, b) that each of them are statistically independent across time m and frequency k, and c) that $X_i(k,m)$, $V_i(k,m)$ and $W_i(k,m)$ are mutually uncorrelated.

In an embodiment, the audio processing system comprises a MVDR beamformer filtering unit to provide filter weights $w_{mvdr}(k,m)$ for estimating the spectral variance $\lambda_X(k,m)$ of the target signal x (or a scaled_version thereof), wherein the filter weights $w_{mvdr}(k,m)$ are based on the look vector $\underline{d}(k,m)$ for the target signal component and the inter-input unit covariance matrix $C_v(k,m)$ for the first noise signal component, and optionally the inter-input unit covariance matrix $C_w(k,m)$ for the second noise signal component, or scaled versions thereof. Preferably, the look vector $\underline{d}(k,m)$ (or a scaled version thereof) for the target signal is predefined, and e.g. stored in a memory of the audio processing system accessible to the spectral variance estimation unit. Preferably, the covariance matrix $C_v(k,m)$ for the first noise signal component (or a scaled version thereof) is predefined and e.g. stored in a memory of the audio processing system accessible to the spectral variance estimation unit. In an embodiment, a predefined covariance matrix $C_{iso}(k,m)$ for an isotropic field is used as an estimate of the inter-input unit covariance matrix $C_v(k,m)$, and e.g. stored in the memory.

In an embodiment, the audio processing system is configured to determine whether or not reverberation and/or additive noise is present in the current acoustic environment. In an embodiment, the audio processing system (or an auxiliary device in communication with the audio processing system) comprises a sensor for providing a measure of a current reverberation, or is adapted to receive such information from an auxiliary device.

In an embodiment, the audio processing device comprises a user interface configured to allow a user to enter information about the current acoustic environment, e.g. whether or not reverberation and/or additive noise is present.

In an embodiment, the audio processing system (e.g. comprising a hearing assistance device, e.g. a hearing aid device) is adapted to provide a frequency dependent gain to compensate for a hearing loss of a user. In an embodiment, the audio processing system comprises a signal processing unit for enhancing the input signals and providing a processed output signal. Various aspects of digital hearing aids are described in [Schaub; 2008].

In an embodiment, the audio processing system comprises an output transducer for converting an electric signal to a stimulus perceived by the user as an acoustic signal. In an embodiment, the output transducer comprises a number of electrodes of a cochlear implant or a vibrator of a bone conducting hearing device. In an embodiment, the output transducer comprises a receiver (speaker) for providing the stimulus as an acoustic signal to the user.

In an embodiment, the audio processing system, specifically an input unit, comprises an input transducer for converting an input sound to an electric input signal. In an embodiment, the audio processing system comprises a directional microphone system adapted to enhance a target acoustic source among a multitude of acoustic sources in the local environment of the user wearing the audio processing system. In an embodiment, the directional system is adapted to detect (such as adaptively detect) from which direction a particular part of the microphone signal originates. This can be achieved in various different ways as e.g. described in the prior art.

In an embodiment, the audio processing system, e.g. an input unit, comprises an antenna and transceiver circuitry for wirelessly receiving a direct electric input signal from another device, e.g. a communication device or another audio processing system, e.g. a hearing assistance device. In an embodiment, the audio processing system (e.g. comprising a hearing assistance device) comprises a (possibly standardized) electric interface (e.g. in the form of a connector) for receiving a wired direct electric input signal from another device, e.g. a communication device or another audio processing device (e.g. comprising a hearing assistance device). In an embodiment, the direct electric input signal represents or comprises an audio signal and/or a control signal and/or an information signal. In an embodiment, the audio processing system comprises demodulation circuitry for demodulating the received direct electric input to provide a direct electric input signal representing an audio signal and/or a control signal. In general, the wireless link established by a transmitter and antenna and transceiver circuitry of the audio processing system can be of any type. In an embodiment, the wireless link is used under power constraints, e.g. in that the audio processing system comprises a portable (typically battery driven) device. In an embodiment, the wireless link is a link based on near-field communication, e.g. an inductive link based on an inductive coupling between antenna coils of transmitter and receiver parts. In another embodiment, the wireless link is based on far-field, electromagnetic radiation (e.g. based on Bluetooth or a related standardized or non-standardized communication scheme).

In an embodiment, the audio processing system is or comprises a portable device, e.g. a device comprising a local energy source, e.g. a battery, e.g. a rechargeable battery.

In an embodiment, the audio processing system comprises a forward or signal path between an input transducer (microphone system and/or direct electric input (e.g. a wireless receiver)) and an output transducer. In an embodiment, the signal processing unit is located in the forward path. In an embodiment, the signal processing unit is adapted to provide a frequency dependent gain according to a user's particular needs. In an embodiment, the audio processing system comprises an analysis path comprising functional components for analyzing the input signal (e.g. determining a level, a modulation, a type of signal, an acoustic feedback estimate, reverberation, etc.). In an embodiment, some or all signal processing of the analysis path and/or the signal path is conducted in the frequency domain. In an embodiment, some or all signal processing of the analysis path and/or the signal path is conducted in the time domain.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 40 kHz (adapted to the particular needs of the application) to provide digital samples $x_n$ (or x[n]) at discrete points in time $t_n$ (or n), each audio sample representing the value of the acoustic signal at $t_n$ by a predefined number $N_s$ of bits, $N_s$ being e.g. in the range from 1 to 16 bits. A digital sample x has a length in time of $1/f_s$, e.g. 50 μs, for $f_s$=20 kHz. In an embodiment, a number of audio samples are arranged in a time frame. In an embodiment, a time frame comprises 64 audio data samples. Other frame lengths may be used depending on the practical application.

In an embodiment, the audio processing system comprise an analogue-to-digital (AD) converter to digitize an analogue input with a predefined sampling rate, e.g. 20 kHz. In an embodiment, the audio processing system comprise a digital-to-analogue (DA) converter to convert a digital signal to an analogue output signal, e.g. for being presented to a user via an output transducer.

In an embodiment, the audio processing system, e.g. the microphone unit, and or the transceiver unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filterbank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain. In an embodiment, the frequency range considered by the audio processing system from a minimum frequency $f_{min}$ to a maximum frequency $f_{max}$ comprises a part of the typical human audible frequency range from 20 Hz to 20 kHz, e.g. a part of the range from 20 Hz to 12 kHz. In an embodiment, a signal of the forward and/or analysis path of the audio processing system is split into a number NI of frequency bands, where NI is e.g. larger than 5, such as larger than 10, such as larger than 50, such as larger than 100, such as larger than 500, at least some of which are processed individually. In an embodiment, the audio processing system is adapted to process a signal of the forward and/or analysis path in a number NP of different frequency channels (NP≤NI). The frequency channels may be uniform or non-uniform in width (e.g. increasing in width with frequency), overlapping or non-overlapping.

In an embodiment, the audio processing system comprises a level detector (LD) for determining the level of an input signal (e.g. on a band level and/or of the full (wide band) signal).

In a particular embodiment, the audio processing system comprises a voice activity detector (VAD) for determining whether or not an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only comprising other sound sources (e.g. artificially generated noise). In an embodiment, the voice detector is adapted to detect as a VOICE also the user's own voice. Alternatively, the voice detector is adapted to exclude a user's own voice from the detection of a VOICE.

In an embodiment, the audio processing system further comprises other relevant functionality for the application in question, e.g. feedback suppression, compression, etc.

In an embodiment, the audio processing system comprises (such as consists of) an audio processing device, e.g. a hearing assistance device, e.g. a hearing aid, e.g. a hearing instrument, e.g. a hearing instrument adapted for being located at the ear or fully or partially in the ear canal of a user, e.g. a headset, an earphone, an ear protection device or a combination thereof.

In the present context, a 'hearing assistance device' refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing assistance device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing assistance device may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The hearing assistance device may comprise a single unit or several units communicating electronically with each other.

More generally, a hearing assistance device comprises an input transducer for receiving an acoustic signal from a user's surroundings and providing a corresponding input audio signal and/or a receiver for electronically (i.e. wired or wirelessly) receiving an input audio signal, a signal processing circuit for processing the input audio signal and an output means for providing an audible signal to the user in dependence on the processed audio signal. In some hearing assistance devices, an amplifier may constitute the signal processing circuit. In some hearing assistance devices, the output means may comprise an output transducer, such as e.g. a loudspeaker for providing an air-borne acoustic signal or a vibrator for providing a structure-borne or liquid-borne acoustic signal. In some hearing assistance devices, the output means may comprise one or more output electrodes for providing electric signals.

In an embodiment, the audio processing system comprises an audio processing device (e.g. a hearing assistance device) and an auxiliary device. In an embodiment, the audio processing system comprises an audio processing device and two or more auxiliary devices.

In an embodiment, the audio processing system is adapted to establish a communication link between the audio processing device and the auxiliary device to provide that information (e.g. control and status signals, possibly audio signals) can be exchanged or forwarded from one to the other.

In an embodiment, at least one of the input units are located in auxiliary device.

In an embodiment, at least one of the noisy audio signal inputs $y_i$ is transmitted from an auxiliary device to an input unit of the audio processing device.

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the audio processing device. In an embodiment, the auxiliary device is or comprises a remote control for controlling functionality and operation of the audio processing device (e.g. hearing assistance device(s). In an embodiment, the function of a remote control is implemented in a SmartPhone, the SmartPhone possibly running an APP allowing to control the functionality of the audio processing device via the SmartPhone (the hearing assistance device(s) comprising an appropriate wireless interface to the SmartPhone, e.g. based on Bluetooth or some other standardized or proprietary scheme).

In an embodiment, the auxiliary device is another audio processing device, e.g. a hearing assistance device. In an embodiment, the audio processing system comprises two hearing assistance devices adapted to implement a binaural listening system, e.g. a binaural hearing aid system.

Use:

In an aspect, use of an audio processing system as described above, in the 'detailed description of embodiments' and in the claims, is moreover provided. In an embodiment, use is provided in a system comprising audio distribution, In an embodiment, use is provided in a system comprising one or more hearing instruments, headsets, ear phones, active ear protection systems, etc., e.g. in handsfree telephone systems, teleconferencing systems, public address systems, karaoke systems, classroom amplification systems, etc. In an embodiment, use of an audio processing system for de-reverberation of an input sound signal or an electric input signal (e.g. to clean-up a noisy, recorded or streamed signal) is provided. In an embodiment, use of an audio processing system for de-reverberation of an input sound signal or an electric input signal (e.g. to clean-up a noisy, recorded or streamed signal) is provided.

Further objects of the application are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element or intervening elements may be present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The disclosure will be explained more fully below in connection with a preferred embodiment and with reference to the drawings in which.

The figures are schematic and simplified for clarity, and they just show details which are essential to the understanding of the disclosure, while other details are left out. Throughout, the same reference signs are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

Figure 1A:
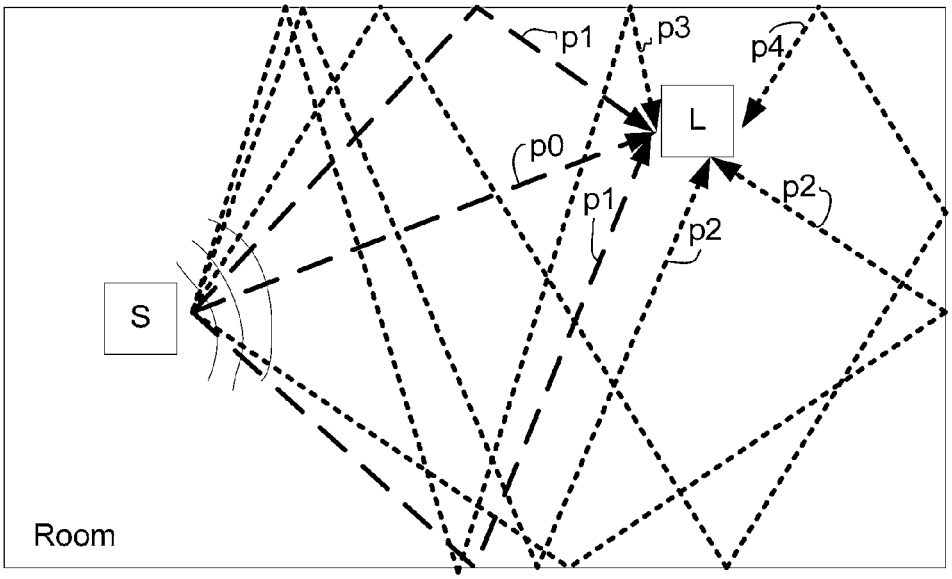
FIGS. 1A-1C schematically show a first scenario comprising a number of acoustic paths between a sound source and a receiver of sound located in a room with reverberation (FIG. 1A) and an exemplary illustration of amplitude versus time for a sound signal in the room (FIG. 1B), and a second scenario comprising a number of acoustic paths between a sound source and a receiver of sound located in a room with reverberation and additive noise, FIGS. 2A-2B schematically illustrate a conversion of a signal in the time domain to the time-frequency domain, FIG. 2A illustrating a time dependent sound signal (amplitude versus time) and its sampling in an analogue to digital converter, FIG. 2B illustrating a resulting 'map' of time-frequency units after a (short-time) Fourier transformation of the sampled signal.
Figure 1B:
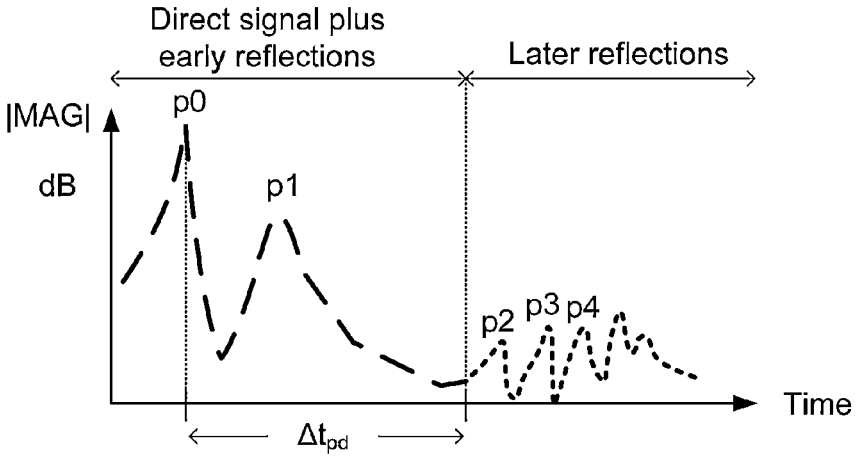

FIG. 1 schematically shows a number of acoustic paths between a sound source and a receiver of sound located in a room (FIG. 1A) and an exemplary illustration of amplitude (|MAG|) versus time (Time) for a sound signal in the room (FIG. 1B).

FIG. 1A schematically shows an example of an acoustically propagated signal from an audio source (S in FIG. 1A) to a listener (L in FIG. 1A) via direct ($p_0$) and reflected propagation paths ($p_1$, $p_2$, $p_3$, $p_4$, respectively) in an exemplary location (Room). The resulting acoustically propagated signal received by a listener, e.g. via a listening device worn by the listener (at L in FIG. 1A) is a sum of the five (and possibly more, depending on the room) differently delayed and attenuated (and possibly otherwise distorted) contributions. The direct ($p_0$) and early reflections (here the one time reflected ($p_1$)) propagation paths are indicated FIG. 1A in dashed line, whereas the 'late reflections' (here the 2, 3, and 4 times reflected ($p_2$, $p_3$, $p_4$)) time reflected ($p_1$)) are indicated FIG. 1A in dotted line. FIG. 1B schematically illustrates an example of a resulting time variant sound signal (magnitude |MAG| [dB] versus time) from the sound source S as received at the listener L. In FIG. 1B a predetermined time $\Delta t_{pd}$ defining the 'late reverberations' is indicated. The late reverberations are in the present example taken to be those signal components that arrive at the listener a time $t_{pd}$ after it was issued by the sound source S. In other words, 'late reverberations' are signal components of a sound that arrive at a given input unit (e.g. the $i^{th}$) a predefined time $\Delta t_{pd}$ after the first peak (p0) of the impulse response has arrived at the input unit in question. In an embodiment, the predefined time $\Delta t_{pd}$ is larger than or equal to 30 ms, such as larger than or equal to 40 ms, e.g. larger than or equal to 50 ms. In an embodiment, such 'late reverberations' include sound components that have been subject to two or more (p2, p3, p4, . . . , as exemplified in FIG. 1), such as three or more reflections from surfaces (e.g.

walls) in the environment. The appropriate number of reflections and/or the appropriate predefined time $\Delta t_{pd}$ separating the target signal components (dashed part of the graph in FIG. 1B) from the (undesired) reverberation (noise) signal components (dotted part of the graph in FIG. 1B) depend on the location (distance to and properties of reflective surfaces) and the distance between audio source (S) and listener (L), the effect of reverberation being smaller the smaller the distance between source and listener.

Figure 1C:
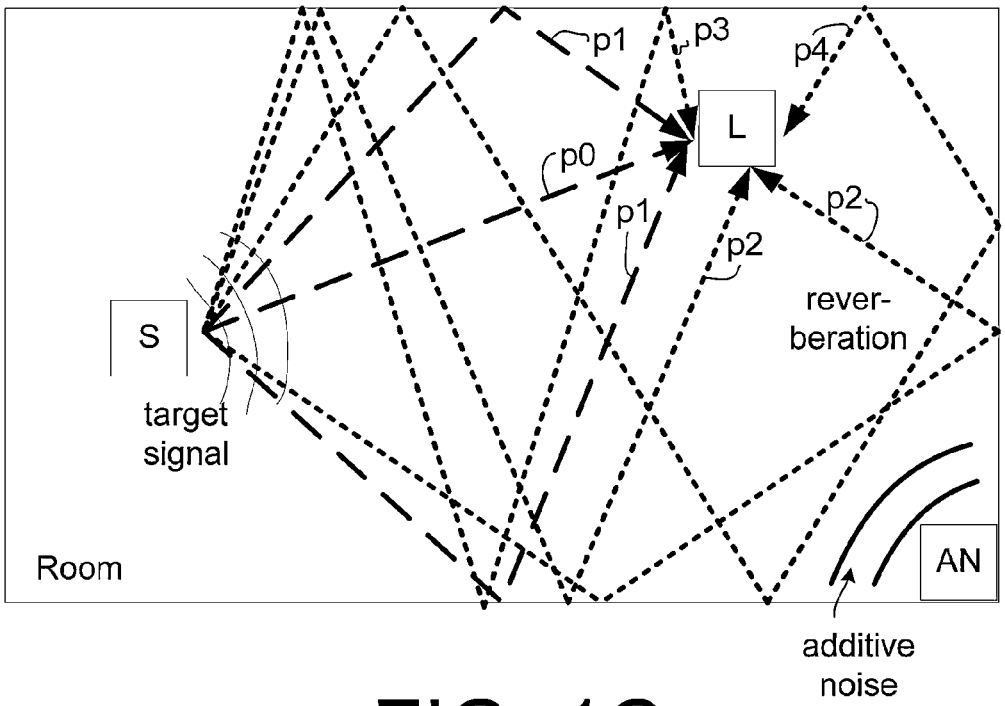

FIG. 1C shows a second scenario comprising a number of acoustic paths between a sound source (S) constituting the target signal and a receiver of sound (L) located in a room (room) with reverberation (reverberation) and additive noise (AD). The characteristics (e.g. an inter input unit covariance matrix $C_w$) of the additive source (AD) are assumed be known.

Figure 2A:
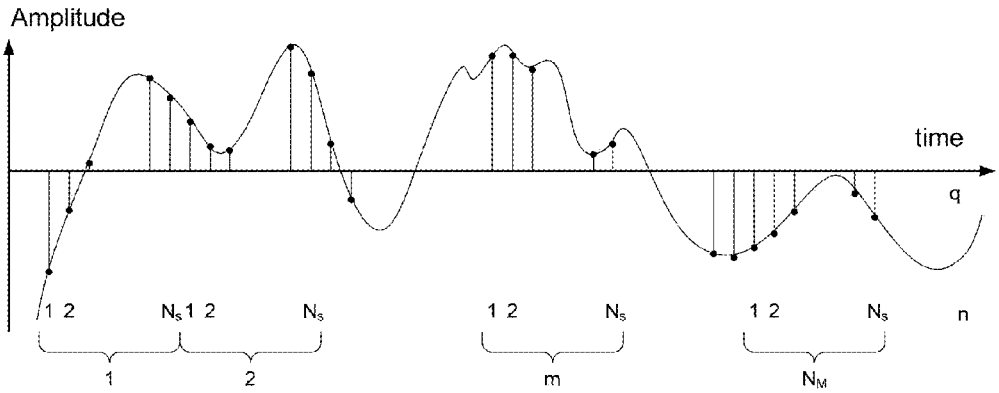
Figure 2B:
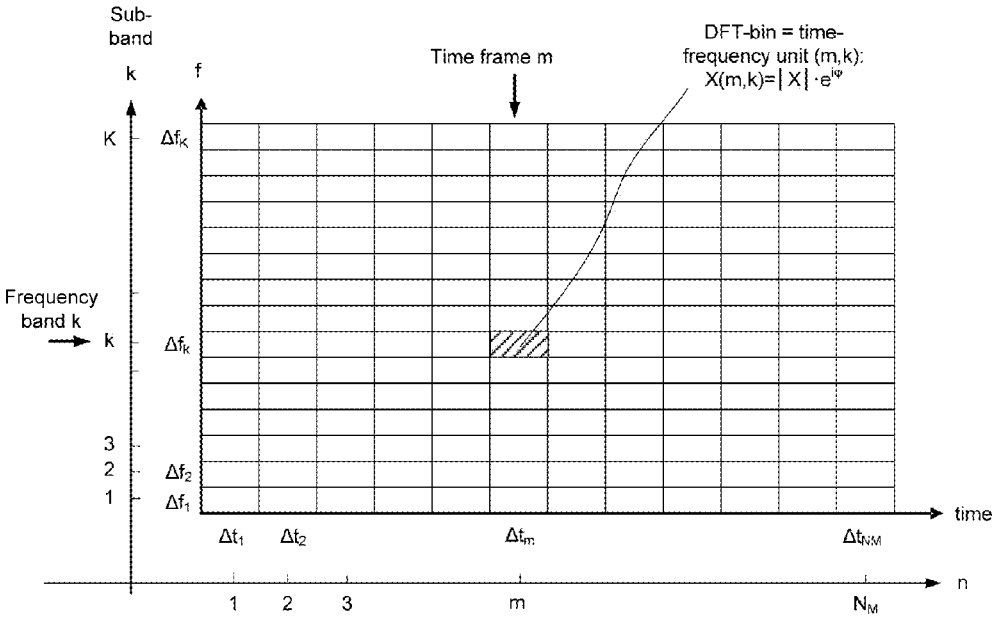

FIG. 2 schematically illustrates a conversion of a signal in the time domain to the time-frequency domain, FIG. 2A illustrating a time dependent sound signal (amplitude versus time) and its sampling in an analogue to digital converter, FIG. 2B illustrating a resulting 'map' of time-frequency units after a (short-time) 2 Fourier transformation of the sampled signal.

FIG. 2A illustrates a time dependent sound signal x(t) (amplitude (SPL [dB]) versus time (t)), its sampling in an analogue to digital converter and a grouping of time samples in frames, each comprising $N_s$ samples. The graph showing a Amplitude versus time (solid line in FIG. 2A) may e.g. represent the time variant analogue electric signal provided by an input transducer, e.g. a microphone, before being digitized by an analogue to digital conversion unit. FIG. 2B illustrates a 'map' of time-frequency units resulting from a Fourier transformation (e.g. a discrete Fourier transform, DFT) of the input signal of FIG. 2A, where a given time-frequency unit (m,k) corresponds to one DFT-bin and comprises a complex value of the signal X(m,k) in question ($X(m,k)=|X|\cdot e^{i\Phi}$, |X|=magnitude and $\phi$=phase) in a given time frame m and frequency band k. In the following, a given frequency band is assumed to contain one (generally complex) value of the signal in each time frame. It may alternatively comprise more than one value. The terms 'frequency range' and 'frequency band' are used in the present disclosure. A frequency range may comprise one or more frequency bands. The Time-frequency map of FIG. 2B illustrates time frequency units (m,k) for k=1, 2, . . . , K frequency bands and m=1, 2, . . . , $N_M$ time units. Each frequency band $\Delta f_k$ is indicated in FIG. 2B to be of uniform width. This need not be the case though. The frequency bands may be of different width (or alternatively, frequency channels may be defined which contain a different number of uniform frequency bands, e.g. the number of frequency bands of a given frequency channel increasing with increasing frequency, the lowest frequency channel(s) comprising e.g. a single frequency band). The time intervals $\Delta t_m$ (time unit) of the individual time-frequency bins are indicated in FIG. 2B to be of equal size. This need not be the case though, although it is assumed in the present embodiments. A time unit $\Delta t_m$ is typically equal to the number $N_s$ of samples in a time frame (cf. FIG. 2A) times the length in time $t_s$ of a sample ($t_s=(1/f_s)$, where $f_s$ is a sampling frequency). A time unit is e.g. of the order of ms in an audio processing system.

Figure 3A:
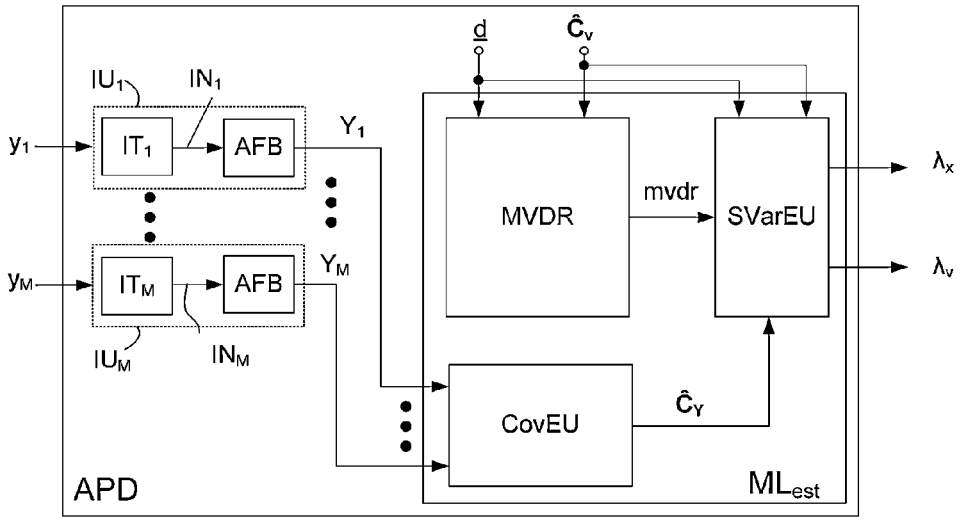
FIGS. 3A-3C show three exemplary embodiments of block diagrams of an audio processing system according to the present disclosure illustrating the proposed scheme of estimation of speech and noise spectral variances, FIG. 3A, 3B illustrating systems adapted to handle a noisy audio signal in the form of a reverberant target speech signal and FIG. 3C illustrating a system adapted to handle a noisy audio signal in the form of a reverberant target speech signal in additive noise.

FIG. 3A schematically shows an embodiment of an audio processing device (APD) according to the present disclosure. The audio processing device (APD) comprises a multitude M of input units ($IU_i$, i=1, 2, . . . , M), each being adapted to provide a time-frequency representation $Y_i$ of a (time varying) noisy input signal $y_i$ at an $i^{th}$ input unit, i=1, 2, . . . , M, where M is larger than or equal to two. The noisy input signal $y_i$ is e.g. a noisy target speech signal comprising a target speech signal component $x_i$ and a (first) noise signal component $v_i$, which is additive and essentially uncorrelated to the target signal (e.g. a speech signal), in other words $y_i(n)=x_i(n)+v_i(n)$, 1=1, 2, . . . , M, where n represents time. In the present context, the noisy audio signal is assumed to be a reverberant target speech signal $y_i$ comprising a target speech signal component $x_i$ and a reverberation signal component $v_i$, as discussed in connection with FIG. 1 above. The time-frequency representation $Y_i(k,m)$ comprises a (generally complex) value of the input signal in a given frequency band k (k=1, 2, . . . . K) and time instance m (m=1, 2, . . . . , Nm). In the embodiment of FIG. 3A, each input unit $IU_i$ comprises an input transducer or an input terminal $IT_i$ for receiving a noisy audio signal $y_i$ (e.g. an acoustic signal or an electric signal) and providing it as an electric input signal $IN_i$ to an analysis filterbank (AFB) for providing a time-frequency representation $Y_i(k,m)$ of the corresponding electric input signal $IN_i$, and hence of the noisy input signal $y_i$. The audio processing device (APD) further comprises a multi-channel MVDR beamformer filtering unit (MVDR) to provide signal mvdr comprising filter weights $w_{mvdr}(k,m)$. The filter weights $w_{mvdr}(k,m)$ are being determined by the MVDR filter unit (MVDR) from a predetermined look vector $\underline{d}(k,m)$ ($\underline{d}$) (or a scaled version thereof) and a predetermined inter-input unit covariance matrix $C_v(k,m)$ ($\hat{C}_v$) (or a scaled version thereof) for the (first) noise signal component of the noisy input signal. In an embodiment, the look vector ($\underline{d}$) and the covariance matrix ($\hat{C}_v$) are predetermined in off-line procedures. The audio processing device (APD) further comprises a covariance estimation unit (CovEU) for estimating an inter input unit covariance matrix $\hat{C}_Y(k,m)$ (or a scaled version thereof) of the noisy input signal based on the time-frequency representation $Y_i(k,m)$ of the noisy audio signals $y_i$. The audio processing device (APD) further comprises a spectral variance estimation unit (SVarEU) for estimating spectral variances $\lambda_X(k,m)$ and $\lambda_V(k,m)$ or scaled versions thereof of the target signal component x and the (first) noise signal component v, respectively. The estimated spectral variances $\lambda_X(k,m)$ and $\lambda_V(k,m)$ are based on the filter weights $w_{mvdr}(k,m)$ (signal mvdr) provided by the MVDR filter, the mvdr, predetermined target look vector ($\underline{d}$) and noise covariance matrix ($\hat{C}_v$) (or scaled versions thereof), and the covariance matrix $\hat{C}_Y(k,m)$ of the noisy audio signal provided by the covariance estimation unit (CovEU). The spectral variance estimation unit (SVarEU) is configured to provide that the estimates of $\lambda_V$ and $\lambda_X$ are jointly optimal in maximum likelihood sense based on the statistical assumptions that the time-frequency representations $Y_i(k,m)$, $X_i(k,m)$, and $V_i(k,m)$ of respective signals $y_i(n)$, and signal components $x_i(n)$, and $v_i(n)$ are zero-mean, complex-valued Gaussian distributed, that each of them are statistically independent across time m and frequency k, and that $X_i(k,m)$ and $V_i(k,m)$ are uncorrelated.

Figure 3B:
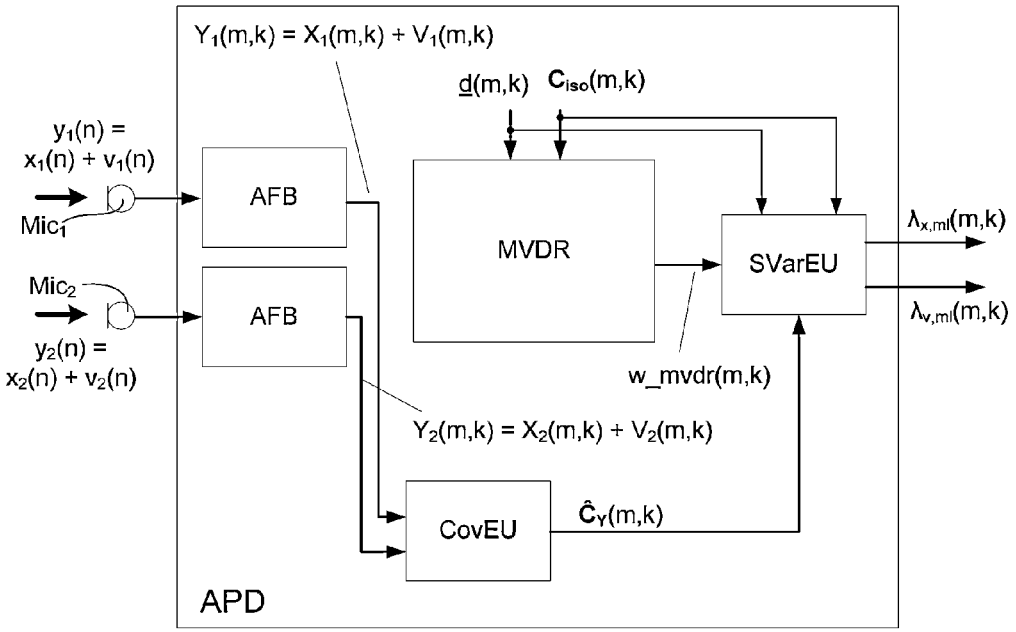

In an embodiment, at least one of the M input units $IU_i$ comprises an input transducer, e.g. a microphone for converting an electric input sound to an electric input signal (cf. e.g. FIG. 3B). The M input units $IU_i$ may all be located in the same physical device. Alternatively, a first ($IU_1$) of the M input units ($IU_i$) is located in the audio processing device (APD, e.g. a hearing aid device), and at second ($IU_2$) of the M input units ($IU_i$) is located a distance to the first input unit that is larger than a maximum outer dimension of the audio processing device (APD) where the first input unit ($IU_1$) is located. In an embodiment, a first of the M input units is located in a first audio processing device (e.g. a first hearing aid device) and a second of the M input units is located in another device, the audio processing device and the other device being configured to establish a communication link between them. In an embodiment, the other device is another audio processing device (e.g. a second hearing aid device of a binaural hearing assistance system). In an embodiment, the other device is or comprises a remote control device of the audio processing device, e.g. embodied in a cellular telephone, e.g. in a SmartPhone.

A. Two Microphone Maximum-Likelihood Estimation of Speech and Late-Reverberation Spectral Variances for Speech Signals in the Presence of Reverberation (Only) (FIG. 3B, 4A):

Another embodiment of an audio processing device according to the present disclosure illustrating a more specific implementation (but comprising the same elements as shown and discussed in FIG. 3A) is shown in FIG. 3B. FIG. 3B shows an audio processing device (APD) for estimation of spectral variances $\lambda_x$, $\lambda_v$ of target speech and reverberation signal components of a noisy input signal, wherein the number (M) of input units is two, and wherein the two input units ($Mic_1$, $Mic_2$) each comprises a microphone unit ($Mic_i$) and an analysis filterbank (AFB in FIG. 3B). It is, as illustrated in FIG. 3A, straightforward to generalize this description to systems with more than 2 microphones (M>2). Also, the two microphones may be located in the same device (e.g. in a listening device, such as a hearing assistance device), but may alternatively be located in different (physically separate) devices, e.g. in two separate audio processing devices, such as in two separate hearing assistance devices of a binaural hearing assistance system, adapted for wirelessly communicating with each other allowing the two microphone signals to be available in the audio processing device (APD) in question. In a preferred embodiment, the audio processing device comprises at least two input units relatively closely spaced apart (within in the housing of the audio processing device) and one input unit located elsewhere, e.g. in another audio processing device, e.g. a SmartPhone.

In the following, the 2-microphone system is described in more detail. Let us assume that one target speaker is present in the acoustical scene, and that the signal reaching the hearing aid microphones consists of the two components a) and b) described above. The goal is to estimate the power at given frequencies and time instants of these two signal components. The signal reaching microphone number i may be written as $$y_i(n)=x_i(n)+v_i(n),$$

where $x_i(n)$ is the target signal component at the microphone, and $v_i(n)$ is the undesired reverberation component, which we assume is uncorrelated with the target signal $x_i(n)$, and $y_i(n)$ is the observable reverberant signal. The reverberant signal at each microphone is passed through an analysis filterbank (AFB) leading to a signal in the time-frequency domain, $$Y_i(k,m)=X_i(k,m)+V_i(k,m),$$

where k is a frequency index and m is a time (frame) index (and i=1, 2). For convenience, these spectral coefficients may be thought of as Discrete-Fourier Transform (DFT) coefficients.

Since all operations are identical for each frequency index, we skip the frequency index in the following for notational convenience. For example, instead of $Y_i(k,m)$, we simply write $Y_i(m)$.

For a given frequency index k and time index m, noisy spectral coefficients for each microphone are collected in a vector (of size 2, since M=2; in general of size M), T indicating vector (matrix) transposition:

$$Y(m)=[Y_1(m)Y_2(m)]^T,$$

$$X(m)=[X_1(m)X_2(m)]^T,$$

and $$V(m)=[V_1(m)V_2(m)]^T,$$

so that $$Y(m)=X(m)+V(m).$$

For a given frame index m, and frequency index k (suppressed in the notation), let $d'(m)=[d'_1(m)\ d'_2(m)]$ denote a vector (of size 2) whose elements $d_1'$ and $d_2'$ represent the (generally complex-valued) acoustic transfer function from target sound source to each microphone ($Mic_1$, $Mic_2$), respectively. It is often more convenient to operate with a normalized version of d'(m). More specifically, let $$d(m)=d'(m)/d'_i(m).$$

denote a vector whose elements $d_i(m)$ (i=1, 2, . . . . , M, here M=2) represent the relative transfer function from the target source to the $i^{th}$ microphone. This implies that the $i^{th}$ element in this vector equals one, and the remaining elements describe the acoustic transfer function from the other microphones to this reference microphone.

This means that the noise free microphone vector X(m) (which cannot be observed directly), can be expressed as $$X(m)=d(m)\overline{X}(m),$$

where $\overline{X}(m)$ is the spectral coefficient of the target signal at the reference microphone.

The inter-microphone covariance matrix for the clean signal is then given by $$C_X(m)=\lambda_X(m)d(m)d(m)^H,$$

where H denotes Hermitian transposition.

In an embodiment, the inter-microphone covariance matrix of the late-reverberation is modelled as the covariance arising from an isotropic field, $$C_V(m)=\lambda_V(m)C_{iso},$$

where $C_{iso}$ is the covariance matrix of the late-reverberation, and $\lambda_V(m)$ is the reverberation power at the reference microphone, which, obviously, is time-varying to take into account the time-varying power level of reverberation.

The inter-microphone covariance matrix is given by $$C_Y(m)=C_X(m)+C_V(m),$$

because the target and late-reverberation signals are assumed to be uncorrelated. Inserting expressions from above, we arrive at the following expression for $C_Y(m)$, $$C_Y(m)=\lambda_X(m)d(m)d(m)^H+\lambda_V(m)C_{iso}.$$

In practice, vector d(m) may be estimated in an off-line calibration procedure (if we assume the target to be in a fixed location compared to the hearing aid microphone array, i.e., if the user "chooses with the nose"), or it may be estimated online.

The matrix $C_{iso}$ is preferably estimated off-line by exposing hearing aids mounted on a dummy head for a reverberant sound field (e.g. approximated as an isotropic field), and measuring the resulting inter-microphone covariance matrix.

Given the expression above, we wish to find estimates of spectral variances $\lambda_X(m)$ and $\lambda_V(m)$. In particular, it is possible to derive the following expressions for maximum likelihood estimates of these quantities. Let $$\hat{C}_Y(m) = \frac{1}{D}\sum_{j=m-D+1}^{m} Y(m)Y(m)^H$$

denote an estimate of the noisy inter-microphone covariance matrix $C_Y(m)$, based on D observations. $\hat{C}_Y$ is determined in a unit for estimating inter-microphone covariance (CovEU in FIG. 3B). Then, the following maximum-likelihood (ml) estimates of spectral variances $\lambda_X(m)$ and $\lambda_V(m)$ can be derived:

$$\boxed{\lambda_{V,ml}(m) = \frac{1}{M-1} tr\left(Q_u(m)\hat{C}_Y(m)C_{iso}^{-1}\right),}$$

with $$Q_u(m)=I-d(m)(d(m)^H C_{iso}^{-1} d(m))^{-1} d(m)^H C_{iso}^{-1},$$

I being the identity matrix (vector), and M=2 is the number of microphones.

Furthermore, $$\lambda_{X,ml}(m)=w_{mvdr}^H(m)(\hat{C}_Y(m)-\lambda_{V,ml}(m)C_{iso})w_{mvdr}(m),$$

where $$w_{mvdr}(m) = \frac{C_{iso}^{-1}d(m)}{d(m)^H C_{iso}^{-1} d(m)}$$

is a vector of filter weights for a minimum-variance distortionless response (MVDR), see e.g. [Haykin; 2001]. The filter weights $w_{mvdr}(m)$ (w_mvdr(m,k) in FIG. 3B) are determined in MVDR filter unit for computing filter weights (MVDR in FIG. 3B). The spectral variances $\lambda_X(m)$ and $\lambda_V(m)$ are estimated in unit for computing spectral variances (SVarEU in FIG. 3B).

The two boxed equations above constitute an embodiment of our proposed method for estimating spectral variances of a target speaker in reverberation, as a function of time (index m) and frequency (suppressed index k).

The spectral variances $\lambda_X(m)$ and $\lambda_V(m)$ have several usages as exemplified in the following sections A1 and A2.

A1. Direct-to-Reverberation Ratio Estimation

The ratio $\lambda_X(m)/\lambda_V(m)$ can be seen as an estimate of the direct-to-reverberation ratio (DRR). The DRR correlates with the distance to the sound source [Hioka et al.; 2011], and is also linked to speech intelligibility. Having a DRR estimate available in a hearing assistance device allows e.g. the device to change to a relevant processing strategy, or to inform the user of the hearing assistance device that the device finds the processing conditions difficult, etc.

A2 De-Reverberation

Figure 4A:
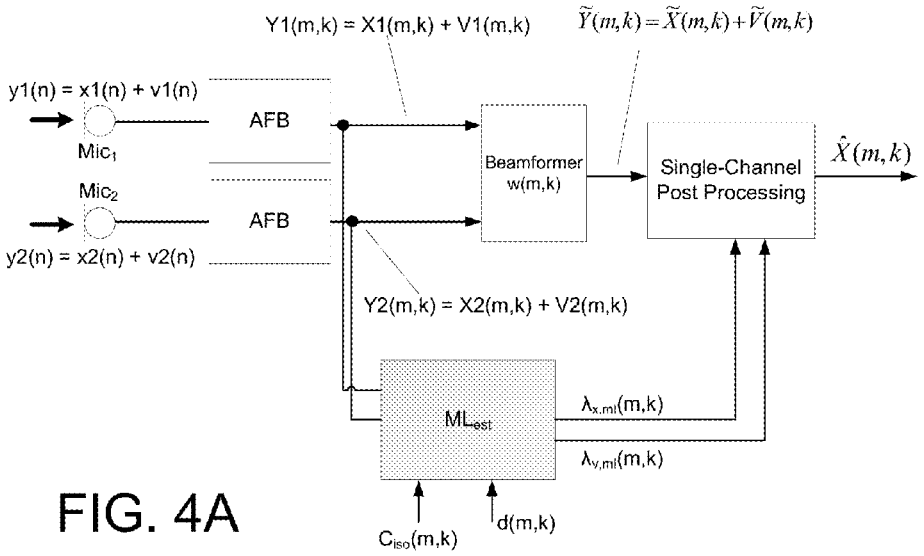
FIGS. 4A-4B show a scenario wherein the method according to the present disclosure (shaded box) is used to compute gain values for a single-channel post-processing step for de-reverberation, FIG. 4A illustrating a system adapted to handle a noisy audio signal in the form of a reverberant target speech signal, FIG. 4B illustrating a system adapted to handle a noisy audio signal in the form of a reverberant target speech signal in additive noise.

A common strategy for de-reverberation in the time-frequency domain is to suppress the time-frequency tiles where the target-to-reverb ratio is small and maintain the time-frequency tiles where the target-to-reverb ration is large (or suppress such TF-tiles less). The perceptual result of such processing is a target signal where the reverberation has been reduced. The crucial component in any such system is to determine from the available reverberant signal which time-frequency tiles are dominated by reverberation, and which are not. FIG. 4A shows a possible way of using the proposed estimation method for de-reverberation.

As before, reverberant microphone signals $y_i$ are decomposed into a time-frequency representation, using analysis filterbanks (AFB in FIG. 4A). The proposed method of processing a noisy audio signal is implemented in unit $ML_{est}$ (shaded box in FIG. 4A corresponding to $ML_{est}$-unit in FIG. 3A), as discussed in connection with FIG. 3, and is applied to the filterbank outputs $Y_1(m,k)$, $Y_2(m,k)$ to estimate spectral variances $\lambda_{X,ml}(m)$ and $\lambda_{V,ml}(m)$ as a function of time (m) and frequency (k). We assume that the noisy microphone signals $Y_1(m,k)$, $Y_2(m,k)$ are passed through a linear beamformer (Beamformer w(m,k) in FIG. 4A) with weights collected in the vector w(m,k). It should be noted that this beamformer may or may not be an MVDR beamformer. If an MVDR beamformer is desired, then the MVDR beamformer weights of the proposed method (inside the shaded box $ML_{est}$ of FIG. 4A) may be re-used (e.g. using unit MVDR in FIG. 3A). The output of the beamformer is then given by $$\tilde{Y}(m)=\tilde{X}(m)+\tilde{V}(m),$$

where $$\tilde{Y}(m)=w(m)^H Y(m),$$

$$\tilde{X}(m)=w(m)^H X(m),$$

and $$\tilde{V}(m)=w(m)^H V(m),$$

where, as before, the frequency index k for notational convenience has been suppressed.

We are interested in estimates of the power of the target component and of the late-reverberation component entering the single-channel post-processing filter. These can be found using our estimated spectral variances as $$\tilde{\lambda}_{X,ml}(m)=E|w(m)^H X(m)|^2=\lambda_{X,ml}(m)|w(m)^H d(m)|^2,$$

and $$\tilde{\lambda}_{V,ml}(m)=E|w(m)^H V(m)|^2=\lambda_{V,ml}(m)w(m)^H C_{iso} w(m),$$

respectively.

So, the power of the target component and of the late-reverberation component entering the single-channel post-processing filter can be found from our maximum-likelihood estimates of spectral variances, $\lambda_{X,ml}(m)$ and $\lambda_{V,ml}(m)$, and quantities which are otherwise available.

The single-channel post-processing filter then uses the estimates $\lambda_{X,ml}(m)$ and $\lambda_{V,ml}(m)$ to find an appropriate gain $g_{SC}(m)$ to apply to the beamformer output, Y(m). That is, $g_{SC}(m)$ may generally be expressed as a function of $\lambda_{X,ml}(m)$ and $\lambda_{V,ml}(m)$ and potentially other parameters. For example, for a Wiener gain function, we have (e.g., [Loizou; 2013])

$$g_{wiener}(m) = \frac{\tilde{\lambda}_{X,ml}(m)/\tilde{\lambda}_{V,ml}(m)}{\tilde{\lambda}_{X,ml}(m)/\tilde{\lambda}_{V,ml}(m)+1},$$

whereas for the Ephraim-Malah gain function [Ephraim-Malah; 1984], we have $$g_{em}(m)=f(\tilde{\lambda}_{X,ml}(m)/\tilde{\lambda}_{V,ml}(m), |\tilde{Y}(m)|^2/\tilde{\lambda}_{V,ml}(m)).$$

Many other possible gain functions exist, but they are typically a function of both $\lambda_{X,ml}(m)$ and $\lambda_{V,ml}(m)$, and potentially other parameters.

Finally, the gain function $g_{SC}(m)$ is applied to the beamformer output Y(m) to result in the de-reverberated time-frequency tile X(m), i.e., $$\hat{X}(m)=g_{SC}(m)\tilde{Y}(m).$$

In an embodiment of the system of FIG. 4A, the Beamformer w(m,k) unit (e.g. an MVDR beamformer) and the Single-Channel Post Processing unit is implemented as a multi-channel Wiener filter (MVF).

Figure 3C:
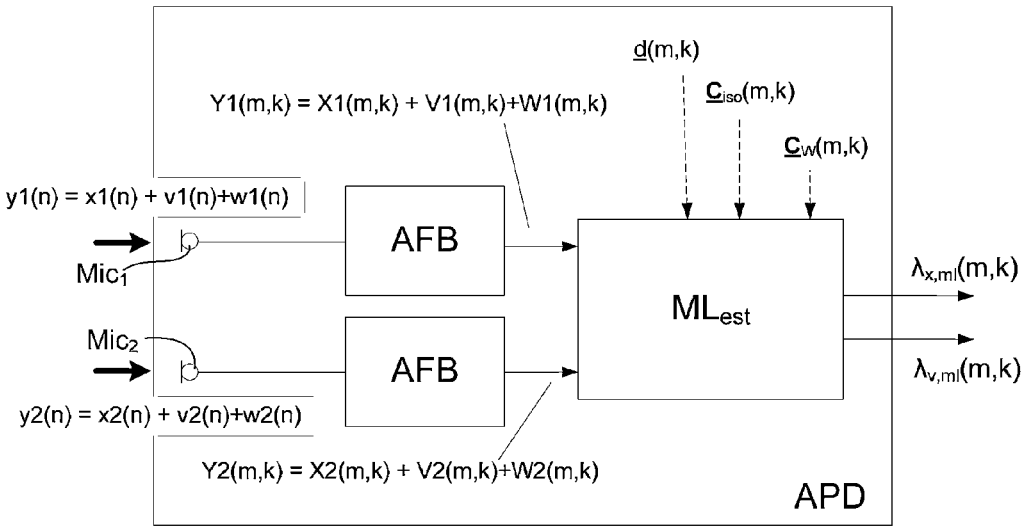
Figure 4B:
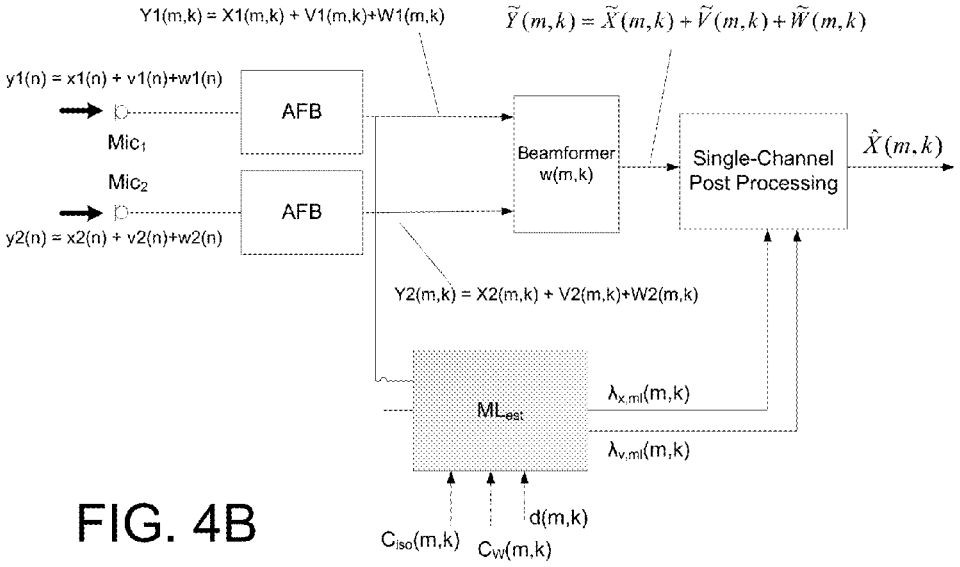

B. Two Microphone Maximum-Likelihood Estimation of Speech and Late-Reverberation Spectral Variances for Speech Signals in the Presence of Reverberation and Additive Noise (FIG. 3C, 4B):

The following outline illustrates yet another embodiment of an audio processing device according to the present disclosure shown in FIG. 3C and FIG. 4B. The description of follows the above description of FIG. 3B and FIG. 4A but represents a scenario where—in addition to reverberant speech—additive noise is assumed to be present. Again, FIG. 3C shows an audio processing device (APD) for estimation of spectral variances $\lambda_x$, $\lambda_v$ of target speech and reverberation signal components of a noisy input signal (here comprising speech, reverberation and additive noise), wherein the number (M) of input units is two, and wherein the two input units ($Mic_1$, $Mic_2$) each comprises a microphone unit ($Mic_i$) and an analysis filterbank (AFB in FIG. 3C). It is straightforward to generalize this description to systems with more than 2 microphones (M>2).

Let us assume that one target speaker is present in the acoustical scene, and that the signal reaching the hearing aid microphones consists of the three components a), b), and c) described above. The goal is to estimate the power at given frequencies and time instants of the signal components a) and b). The observable reverberant signal $y_i(n)$ reaching microphone number i may be written as $$y_i(n)=x_i(n)+v_i(n)+w_i(n),$$

where $x_i(n)$ is the target signal component at the microphone, $v_i(n)$ is the undesired reverberation component, and $w_i(n)$ is the additive noise component, which are all assumed to be mutually uncorrelated with each other. The reverberant signal at each microphone is passed through an analysis filter bank leading to a signal in the time-frequency domain, $$Y_i(k,m)=X_i(k,m)+V_i(k,m)+W_i(k,m),$$

where k is a frequency index and m is a time (frame) index. For convenience, these spectral coefficients may be thought of as Discrete-Fourier Transform (DFT) coefficients.

Since all operations are identical for each frequency index, we skip the frequency index in the following for notational convenience. For example, instead of $Y_i(k,m)$, we simply write $Y_i(m)$.

For a given frequency index k and time index m, noisy spectral coefficients for each microphone are collected in a vector, $$Y(m)=[Y_1(m)Y_2(m)]^T,$$

$$X(m)=[X_1(m)X_2(m)]^T,$$

$$V(m)=[V_1(m)V_2(m)]^T,$$

and $$W(m)=[W_1(m)W_2(m)]^T$$

so that $$Y(m)=X(m)+V(m)+W(m).$$

For a given frame index m, and frequency index k (suppressed in the notation), let $$d'(m)=[d'_1(m)d'_2(m)]$$

denote the (generally complex-valued) acoustic transfer function from target sound source to each microphone. It is often more convenient to operate with a normalized version of d'(m). More specifically, let $$d(m)=d'(m)/d'_i(m).$$

denote a vector whose elements $d_i(m)$ represent the relative transfer function from the target source to the ith microphone. This implies that the ith element in this vector equals one, and the remaining elements describe the acoustic transfer function from the other microphones to this reference microphone.

This means that the noise free microphone vector X(m) (which cannot be observed directly), can be expressed as $$X(m)=d(m)\overline{X}(m),$$

where $\overline{X}(m)$ is the spectral coefficient of the target signal at the reference microphone.

The inter-microphone covariance matrix for the clean signal is then given by $$C_X(m)=\lambda_X(m)d(m)d(m)^H,$$

where H denotes Hermitian transposition.

We model the inter-microphone covariance matrix of the late-reverberation as the covariance arising from an isotropic field, $$C_V(m)=\lambda_V(m)C_{iso},$$

where $C_{iso}$ is the covariance matrix of the late-reverberation, normalized to have a value of 1 at the diagonal element corresponding to reference microphone, and $\lambda_V(m)$ is the reverberation power at the reference microphone, which, obviously, is time-varying to take into account the time-varying power level of reverberation.

Finally, we assume that the covariance matrix of the additive noise is known and time-invariant. In practice, this matrix can be estimated from noise-only signal regions preceding speech activity, using a voice-activity detector.

The inter-microphone covariance matrix of the noisy and reverberant signal is then given by $$C_Y(m)=C_X(m)+C_V(m)+C_W,$$

because the target, the late-reverberation, and the noise were assumed mutually uncorrelated. As mentioned, $C_W$ is assumed known and constant (hence the lack of time-index). Inserting expressions from above, we arrive at the following expression for $C_Y(m)$, $$C_Y(m)=\lambda_X(m)d(m)d(m)^H+\lambda_V(m)C_{iso}+C_W.$$

In practice, vector d(m) may be estimated in an off-line calibration procedure (if we assume the target to be in a fixed location compared to the hearing aid microphone array, i.e., if the user "chooses with the nose"), or it may be estimated online.

Matrix $C_{iso}$ is estimated offline by exposing hearing aids mounted on a dummy head for a reverberant sound field (e.g. approximated as an isotropic field), and measuring the resulting inter-microphone covariance matrix.

Given the expression above, we wish to find estimates of spectral variances $\lambda_X(m)$ and $\lambda_V(m)$. In particular, it is possible to derive the following expressions for maximum likelihood estimates of these quantities. Let $$\hat{C}_Y(m) = \frac{1}{D}\sum_{j=m-D+1}^{m} Y(j)Y(j)^H$$

denote an estimate of the noisy inter-microphone covariance matrix $C_Y(m)$, based on D observations.

B1 Special Case: No Additive Noise ($C_W=0$)

We first consider the case when there is no additive noise present ($C_W=0$), because in this case the resulting ML estimators are particularly simple. In practice, the noise is never completely absent, but the following results hold for high signal-to-noise ratios, i.e., when $C_W$ is small compared to $C_Y(m)$, or in very reverberant situations, i.e., when $C_W$ is small compared to $C_X(m)$.

In this case, the following maximum-likelihood estimates of spectral variances $\lambda_X(m)$ and $\lambda_V(m)$ can be derived:

$$\boxed{\lambda_{V,ml}(m) = \frac{1}{M-1} tr\left(Q_u(m)\hat{C}_Y(m)C_{iso}^{-1}\right),}$$

where $$Q_u(m)=I-d(m)(d(m)^H C_{iso}^{-1} d(m))^{-1} d(m)^H C_{iso}^{-1},$$

and M=2 is the number of microphones. Furthermore, $$\lambda_{X,ml}(m)=w_{mvdr}^H(m)(\hat{C}_Y(m)-\lambda_{V,ml}(m)C_{iso})w_{mvdr}(m),$$

where $$w_{mvdr}(m) = \frac{C_{iso}^{-1}d(m)}{d(m)^H C_{iso}^{-1} d(m)}$$

is a vector of filter weights for an minimum-variance distortionless response (MVDR), see e.g. [Haykin; 2001].

The two boxed equations above constitute an embodiment of the proposed method in the special case of low additive noise, for estimating spectral variances of a target speaker in reverberation, as a function of time (index m) and frequency (suppressed index k), same result as provided in section A above.

B2. General Case: Additive Noise ($C_W\neq 0$)

To express the maximum likelihood estimates of the spectral variances $\lambda_X(m)$ and $\lambda_V(m)$ in this general case, we need to introduce some additional notation.

First, let us introduce an M×M−1 complex-valued blocking matrix $B\in C^{M\times M-1}$ given by $$[Bd]=I-d(m)(d(m)^H d(m))^{-1} d(m)^H,$$

i.e., the matrix B is given by the first M−1 columns of the matrix on the right-hand side.

Also, let us define a pre-whitening matrix $D\in C^{M-1\times M-1}$, which has the property that $$(B^H C_W B)^{-1}=D^H D.$$

Matrix D can, e.g., be found from a Cholesky decomposition of the matrix on the left-hand side above.

In any case, matrices B and D can be computed from known quantities at any time instant m.

To describe the maximum likelihood estimates compactly, we need to introduce the signal quantities from the previous section in a blocked and whitened domain. The quantities in this new domain are denoted with '. We define $$Y'(m)=D^H B^H Y(m),$$

and similarly for X'(m), V'(m), and W'(m). Covariance matrices in this blocked and pre-whitened domain are given by $$C_{Y'}(m)=D^H B^H C_Y(m) BD,$$

and similarly for $C_{X'}(m)$, $C_{iso'}(m)$, $C_{W'}(m)$, and $\hat{C}_{Y'}(m)$. Note that all these (square) covariance matrices have dimension M'=M−1, where M is the number of microphones.

Finally, let us introduce some additional notation. Let $$C_{Y'}(m)=U\Lambda_{Y'}U^H$$

denote the eigenvalue decomposition of the (blocked and pre-whitened) covariance matrix $C_{Y'}(m)$, where the columns of matrix U are eigen vectors and diagonal elements of the diagonal matrix $$\Lambda_{Y'}=\mathrm{diag}(\lambda_{y,1} \ldots \lambda_{y,M'}).$$

Similarly, let $$C_{iso'}=U\Lambda_{iso'}U^H$$

denote the eigenvalue decomposition of the (blocked and pre-whitened) matrix $C_{iso'}$, such that $$\Lambda_{iso'}=\mathrm{diag}(\lambda_{iso,1}, \ldots, \lambda_{iso,M'})$$

is a diagonal eigen value matrix.

Furthermore, let $g_m$ denote the m'th diagonal element of the matrix $$U^H \hat{C}_{Y'}(m)U.$$

Then it can be shown that the maximum likelihood estimate $\lambda_{V,ML}$ of $\lambda_V$ can be found as one of the roots of the polynomial (in the variable $\lambda_V$):

$$-\sum_{m=1}^{M'} \lambda_{iso,m}(\lambda_V \lambda_{iso,m} + 1 - g_m) \prod_{k=1}^{M',k\neq m} (\lambda_V \lambda_{iso,k} + 1)^2 = 0.$$

Specifically, $\lambda_V(m)$ is found as the positive, real root of the polynomial. In most cases, there is only one such root.

The corresponding maximum-likelihood estimate $\lambda_{X,ML}(m)$ of the target speech spectral variance $\lambda_X(m)$ can then be found from quantities in the non-blocked and non-prewhitened domain as:

$$\lambda_{X,ML}(m)=w_{mvdr}^H(m)(\hat{C}_Y(m)-\lambda_{V,ML}(m)C_{iso}-C_W)w_{mvdr}(m),$$

where $$w_{mvdr}(m) = \frac{C_{V+W}^{-1}(m)d(m)}{d(m)^H C_{V+W}^{-1}(m)d(m)},$$

where $$C_{V+W}(m)=\lambda_{V,ML}(m)C_{iso}+C_W.$$

The spectral variances $\lambda_X(m)$ and $\lambda_V(m)$ have several usages as exemplified in the following sections B3 and B4.

B3. Direct-to-Reverberation Ratio Estimation

The ratio $\lambda_X(m)/\lambda_V(m)$ can be seen as an estimate of the direct-to-reverberation ratio (DRR). The DRR correlates with the distance to the sound source [Hioka et al.; 2011], and is also linked to speech intelligibility. Having available on-board a hearing a DRR estimate allows the hearing aid to change to a relevant processing strategy, or informs the hearing aid user that the hearing aid finds the processing conditions difficult, etc.

B4. Dereverberation—Special Case with No (or Low) Additive Noise ($C_W=0$)

In this special case, the target signal is disturbed by reverberation, but no additional noise.

A common strategy for dereverberation in the time-frequency domain is to suppress the time-frequency tiles where the target-to-reverb ratio is small and maintain the time-frequency tiles where the target-to-reverb ration is large. The perceptual result of such processing is a target signal where the reverberation has been reduced. The crucial component in any such system is to determine from the available reverberant signal which time-frequency tiles are dominated by reverberance, and which are not. FIG. 4B shows a possible way of using the proposed estimation method for dereverberation.

As before, reverberant microphone signals are decomposed into a time-frequency representation, using analysis filter banks. The proposed method (shaded box) is applied to the filter bank output to estimate spectral variances $\lambda_{X,ml}(m)$ and $\lambda_{V,ml}(m)$ as a function of time and frequency. We assume that the noisy microphone signals are passed through a linear beamformer with weights collected in the vector w(m,k). This beamformer may or may not be an MVDR beamformer. If an MVDR beamformer is desired, then the MVDR beamformer of the proposed method (inside the shaded $ML_{est}$-box) in FIG. 4B may be re-used.) The output of the beamformer is then given by $$\tilde{Y}(m)=\tilde{X}(m)+\tilde{V}(m),$$

where $$\tilde{Y}(m)=w(m)^H Y(m),$$

$$\tilde{X}(m)=w(m)^H X(m),$$

and $$\tilde{V}(m)=w(m)^H V(m),$$

where, as before, we skipped the frequency index k for notational convenience.

We are interested in estimates of the power of the target component and of the late-reverberation component entering the single-channel post-processing filter. These can be found using our estimated spectral variances as $$\tilde{\lambda}_{X,ml}(m)=E|w(m)^H X(m)|^2=\lambda_{X,ml}(m)|w(m)^H d(m)|^2,$$

and $$\tilde{\lambda}_{V,ml}(m)=E|w(m)^H V(m)|^2=\lambda_{V,ml}(m)w(m)^H C_{iso}w(m),$$

respectively.

So, the power of the target component and of the late-reverberation component entering the single-channel post-processing filter can be found from our maximum-likelihood estimates of spectral variances, $\lambda_X(m)$ and $\lambda_V(m)$, and quantities which are otherwise available.

The single-channel post-processing filter then uses the estimates $\tilde{\lambda}_{X,ml}(m)$ and $\tilde{\lambda}_{V,ml}(m)$ to find an appropriate gain $g_{SC}(m)$ to apply to the beamformer output, $\tilde{Y}(m)$. That is, $g_{SC}(m)$ may generally be expressed as a function of $\tilde{\lambda}_{X,ml}(m)$ and $\tilde{\lambda}_{V,ml}(m)$ and potentially other parameters. For example, for a Wiener gain function, we have (e.g., [Loizou; 2013])

$$g_{wiener}(m)=\frac{\tilde{\lambda}_{X,ml}(m)/\tilde{\lambda}_{V,ml}(m)}{\tilde{\lambda}_{X,ml}(m)/\tilde{\lambda}_{V,ml}(m)+1},$$

whereas for the Ephraim-Malah gain function [Ephraim-Malah; 1984], we have $$g_{em}(m)=f(\tilde{\lambda}_{X,ml}(m)/\tilde{\lambda}_{V,ml}(m),|\tilde{Y}(m)|^2/\tilde{\lambda}_{V,ml}(m)).$$

Many other possible gain functions exist, but they are typically a function of both $\tilde{\lambda}_{X,ml}(m)$ and $\tilde{\lambda}_{V,ml}(m)$, and potentially other parameters.

Finally, the gain function $g_{SC}(m)$ is applied to the beamformer output $\tilde{Y}(m)$ to result in the dereverberated time-frequency tile $\hat{X}(m)$, i.e., $$\hat{X}(m)=g_{SC}(m)\tilde{Y}(m).$$

as also disclosed in section A above.

B5. Dereverberation—General Case with Additive Noise ($C_W\neq 0$)

In the general case, the target signal is disturbed by both reverberation and additive noise. Analogously to the previous section, we are interested in the spectral variances of all signal components, entering the single-channel postfilter. As above, the spectral variances of the target and the reverberation component can be found from the maximum-likelihood estimates as $$\tilde{\lambda}_{X,ml}(m)=E|w(m)^H X(m)|^2=\lambda_{X,ml}(m)|w(m)^H d(m)|^2,$$

and $$\tilde{\lambda}_{V,ml}(m)=E|w(m)^H V(m)|^2=\lambda_{V,ml}(m)w(m)^H C_{iso}w(m),$$

respectively.

Furthermore, the spectral variance of the additive noise component entering the single-channel beamformer is given by $$\lambda_W(m)=E|w(m)^H W(m)|^2=w(m)^H C_W w(m)$$

Generally speaking, the single-channel postfilter gain is function of function of $\tilde{\lambda}_{X,ml}(m)$, $\tilde{\lambda}_{V,ml}(m)$, $\lambda_W(m)$, and potentially other parameters. For example, one could define the total spectral disturbance as the sum of the reverberation and noise variances, $$\lambda_{dist}(m)=\tilde{\lambda}_{V,ml}(m)+\lambda_W(m).$$

Then a signal-to-total-disturbance ratio would be given by $$\xi(m)=\tilde{\lambda}_{V,ml}(m)/\lambda_{dist}(m).$$

With this, new versions of the Wiener gain function or the Ephraim-Malah gain function could be defined analogously to the description above. However, rather than suppressing only the reverberation component, these new gain functions suppress the reverberation and the additive noise component jointly.

Figure 5:
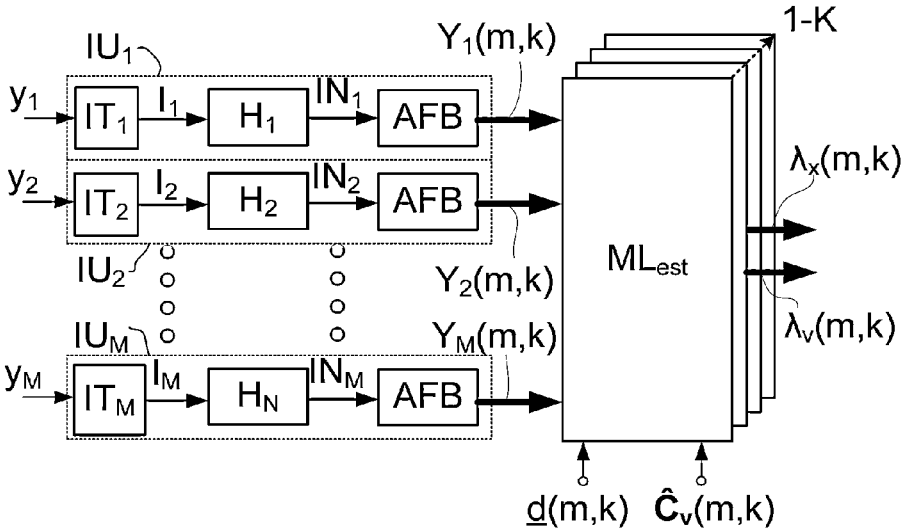
FIG. 5 shows an embodiment of an audio processing system according to the present disclosure.

FIG. 5 shows an embodiment of an audio processing system (APD) according to the present disclosure. The audio processing system (APD) comprises the same elements as shown in FIG. 3A: Input units $IU_i$, i=1, 2, M providing time-frequency representations Y of noisy audio signals y (comprising a target signal component x and a first noise signal component v, and optionally a second, additive noise signal component w) to a maximum likelihood estimations unit $ML_{est}$ for estimating spectral variances $\lambda_{X,ml}(m)$ and $\lambda_{V,ml}(m)$ of the target signal component x and a first noise signal component v, respectively (or scaled versions thereof). In the embodiment of FIG. 5 input units $UI_i$ further comprise normalization filter units $H_i$. The normalization filter units have a transfer function $H_i(k)$, which makes the source providing the electric input signal in question comparable and interchangeable with the other sources. This has the advantage that the signal contents of the individual noisy input signals $y_i$ can be compared. The $i^{th}$ input unit $IU_i$ (i=1, 2, . . . , M) comprises input transducer $IT_i$ for converting an input sound signal $y_i$ to an electric input signal $I_i$ or another input device for providing the electric input signal $I_i$ Normalization filter $H_i$ (e.g. an adaptive filter) filters electric input signal $I_i$ to a normalized signal $IN_i$ (e.g. within a predetermined voltage range) and feeds the normalized time domain signal $IN_i$ to analysis filterbank AFB, which provides a time-frequency representation $Y_i(m,k)$ of the noisy input signal $y_i$ to the maximum likelihood estimation unit $ML_{est}$. This allows to compensate unmatched microphones, to use different kinds of sensors (microphones, vibration sensors, optical sensors, electrodes e.g. for sensing brain waves, etc.), to compensate for different location of sensors, etc. The maximum likelihood estimations unit $ML_{est}$ further receives predetermined target look vector ($\underline{d}$) and noise covariance matrix ($\hat{C}_v$) (or scaled versions thereof) allowing estimation of spectral variances $\lambda_{X,ml}(m)$ and $\lambda_{V,ml}(m)$. The processing in the $ML_{est}$ unit is indicated in FIG. 5 to be performed in individual frequency bands k, k=1, 2, . . . , K, by the solid 'shadow boxes' denoted 1-K 'behind' the front $ML_{est}$ box). In an embodiment, where a second, additive noise component $w_i$ is present in the noisy input signals $y_i$, a further predetermined noise covariance matrix ($\hat{C}_w$) for the additive noise is assumed to be provided to the maximum likelihood estimation unit $ML_{est}$.

Figure 6:
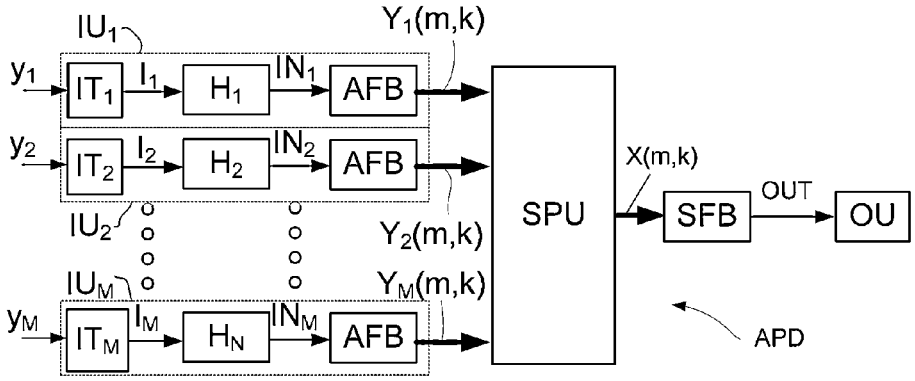
FIG. 6 shows a further embodiment of an audio processing device according to the present disclosure.

FIG. 6 shows an embodiment of an audio processing device according to the present disclosure comprising the same elements as the embodiment in FIG. 5, only the maximum likelihood estimations unit $ML_{est}$ for estimating spectral variances $\lambda_{X,ml}(m)$ and $\lambda_{V,ml}(m)$ form part of more general signal processing unit SPU comprising e.g. also beamformer and single channels post filtering as discussed in connection with FIG. 4 and/or other signal processing making use of spectral variances $\lambda_{X,ml}(m)$ and $\lambda_{V,ml}(m)$ (or scaled versions thereof). The signal processing unit SPU comprises a memory wherein characteristics of the target and noise signal components are stored, e.g. a predetermined target look vector ($\underline{d}$) and first noise covariance matrix ($\hat{C}_v$, e.g. $C_{iso}$) and optionally a second covariance matrix ($C_w$) (or scaled versions thereof). The signal processing unit SPU provides enhanced, e.g. de-reverberated, signal X(m,k). The signal processing unit SPU may e.g. be configured to apply a frequency dependent gain to the resulting enhanced signal X to compensate for a hearing impairment of a user. The embodiment of FIG. 6 further comprises synthesis filterbank SFB for converting the enhanced time-frequency domain signal X(m,k) to time domain (output) signal OUT, which may be further processed or as here fed to output unit OU. The output unit may be an output transducer for converting an electric signal to a stimulus perceived by the user as an acoustic signal. In an embodiment, the output transducer comprises a receiver (speaker) for providing the stimulus as an acoustic signal to the user. The output unit OU may alternatively or additionally comprise a number of electrodes of a cochlear implant hearing device or a vibrator of a bone conducting hearing device or a transceiver for transmitting the resulting signal to another device. The embodiment of an audio processing device shown in FIG. 6 may implement a hearing assistance device.

Figure 7:
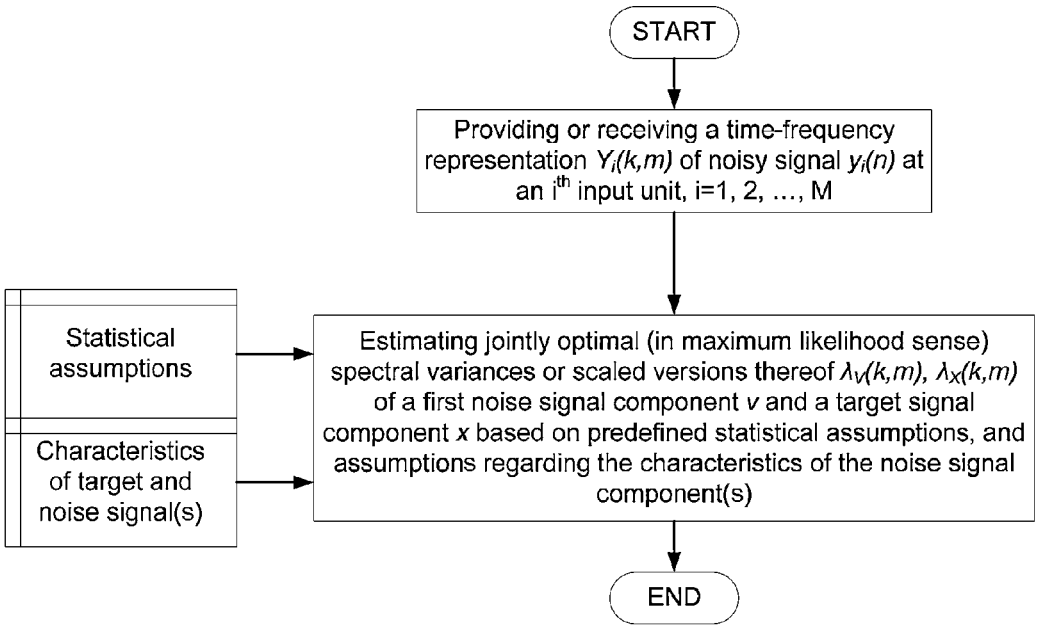
FIG. 7 shows a flow diagram illustrating a method of processing a noisy input signal according to the present disclosure.

FIG. 7 shows a flow diagram illustrating a method of processing a noisy input signal according to the present disclosure. The noisy audio signal y(n) comprises a target signal component x(n) and a first noise signal component v(n) (and optionally a second additive noise component w(n)), n representing time. The method comprises the steps of a) Providing or receiving a time-frequency representation $Y_i(k,m)$ of the noisy audio signal $y_i(n)$ at an $i^{th}$ input unit, i=1, 2, . . . , M, where M is larger than or equal to two, in a number of frequency bands and a number of time instances, k being a frequency band index and m being a time index;

b) Estimating spectral variances or scaled versions thereof $\lambda_V$, $\lambda_X$ of said first noise signal component v and said target signal component x, respectively, as a function of frequency index k and time index m, said estimates of $\lambda_V$ and $\lambda_X$ being jointly optimal in maximum likelihood sense.

The maximum likelihood optimization is based (exclusively) on the following statistical assumptions that the time-frequency representations $Y_i(k,m)$, $X_i(k,m)$, and $V_i(k,m)$ (and optionally $W_i(k,m)$) of respective signals $y_i(n)$, and signal components $x_i(n)$, and $v_i(n)$ (and optionally $w_i(n)$) are zero-mean, complex-valued Gaussian distributed, that each of them are statistically independent across time m and frequency k, and that $X_i(k,m)$ and $V_i(k,m)$ (and optionally $W_i(k,m)$) are mutually uncorrelated The method is—in general—based on the assumption that characteristics (e.g. spatial characteristics) of the target and noise signal components are known.

The assumptions regarding the characteristics of the target and noise signal components are e.g. that the direction to the target signal relative to the input units is known (fixed $\underline{d}$) and that the spatial fingerprint of the first noise signal component is also known, e.g. isotropic ($C_v$=$C_{iso}$). In case a second, additive noise component is present, it is assumed that its characteristics in the form of an inter input covariance matrix $C_w$ is known.

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims and equivalents thereof.

REFERENCES

US2009248403A

WO12159217A1

US2013343571A1

US2010246844A1

[Braun&Habets; 2013] S. Braun and E. A. P. Habets, "Dereverberation in noisy environments using reference signals and a maximum likelihood estimator", Presented at the 21st European Signal Processing Conference (EUSIPCO 2013), 5 pages (EUSIPCO 2013 1569744623).

[Schaub; 2008] Arthur Schaub, "Digital hearing Aids", Thieme Medical. Pub., 2008.

[Haykin; 2001] S. Haykin, "Adaptive Filter Theory," Fourth Edition, Prentice Hall Information and System Sciences Series, 2001.

[Hioka et al.; 2011]: Y. Hioka, K. Niwa, S. Sakauchi, K. Furuya, and Y. Haneda, "Estimating Direct-to-Reverberant Energy Ratio Using D/R Spatial Correlation Matrix Model", IEEE Trans. Audio, Speech, and Language Processing, Vol. 19, No. 8, November 2011, pp. 2374-2384.

[Loizou; 2013]: P. C. Loizou, "Speech Enhancement: Theory and Practice," Second Edition, February, 2013, CRC Press

[Ephraim-Malah; 1984]: Y. Ephraim and D. Malah, "Speech Enhancement Using a Minimum Mean-Square Error Short-Time Spectral Amplitude Estimator," IEEE Trans. Acoustics, Speech, and Signal Processing, Vol. ASSP-32, No. 6, December 1984, pp. 1109-1121.

[Kjems&Jensen; 2012] U. Kjems, J. Jensen, "Maximum likelihood based noise covariance matrix estimation for multi-microphone speech enhancement", 20th European Signal Processing Conference (EUSIPCO 2012), pp. 295-299, 2012.

[Ye&DeGroat; 1995] H. Ye and R. D. DeGroat, "Maximum likelihood DOA estimation and asymptotic Cram'er-Rao bounds for additive unknown colored noise," Signal Processing, IEEE Transactions on, vol. 43, no. 4, pp. 938-949, 1995.

[Shimitzu et al.; 2007] Hikaru Shimizu, Nobutaka Ono, Kyosuke Matsumoto, Shigeki Sagayama, Isotropic noise suppression in the power spectrum domain by symmetric microphone arrays, 2007 IEEE Workshop on Applications of Signal Processing to Audio and Acoustics, Oct. 21-24, 2007, New Paltz, N.Y., pp. 54-57.

The invention claimed is:

1. A method of processing a noisy audio signal y(n) including a target signal component x(n) and a first noise signal component v(n), n representing time, the method comprising:

providing or receiving a time-frequency representation $Y_i(k,m)$ of the noisy audio signal $y_i(n)$ at an $i^{th}$ input unit, i=1, 2, . . . , M, where M is larger than or equal to two, in a number of frequency bands and a number of time instances, k being a frequency band index and m being a time index;

providing characteristics of said target signal component represented by a look vector d(k,m), whose elements (i=1, 2, . . . , M) define the frequency and time dependent absolute acoustic transfer function from a target signal source to each of the M input units, or the relative acoustic transfer function of the ith input unit to a reference input unit, or an inter input covariance matrix $d(k,m)\cdot d(k,m)^H$;

providing characteristics of said first noise signal component defined by an inter input unit covariance matrix $C_v(k,m)$;

estimating spectral variances or scaled versions thereof $\lambda_V$, $\lambda_X$ of said first noise signal component v and said target signal component x, respectively, as a function of frequency index k and time index m, said estimates of $\lambda_V$ and $\lambda_X$ being jointly optimal in maximum likelihood sense, jointly optimal being taken to mean that both of the spectral variance $\lambda_V$, $\lambda_X$ are estimated in the same maximum likelihood estimation process, based on the statistical assumptions that a) the time-frequency representations $Y_i(k,m)$, $X_i(k,m)$, and $V_i(k,m)$ of respective signals $y_i(n)$, and signal components $x_i(n)$, and $v_i(n)$ are zero-mean, complex-valued Gaussian distributed, b) that each of them are statistically independent across time m and frequency k, and c) that $X_i(k,m)$ and $V_i(k,m)$ are uncorrelated; and processing the noisy audio signal $y_i(n)$ based on the estimated spectral variances or scaled versions thereof to provide a noise reduced signal.

2. A method according to claim 1 wherein the noisy audio signal $y_i(n)$ comprises a reverberant signal comprising a target signal component and a reverberation signal component.

3. A method according to claim 1 wherein said characteristics of the first noise signal component v is represented by an inter input unit covariance matrix $C_v$ or a scaled version thereof and wherein said first noise signal component $v_i(n)$ is essentially spatially isotropic.

4. A method according to claim 1 wherein said first noise signal component $v_i(n)$ is constituted by late reverberations.

5. A method according to claim 1 wherein the first noise signal component is a reverberation signal component v(n), and the noisy audio signal y(n) further comprises a second noise signal component being an additive noise signal component w(n), and wherein the method further comprises providing characteristics of said second noise signal component defined by a predetermined inter input unit covariance matrix $C_w(k,m)$.

6. A method according to claim 5 wherein the noisy audio signal $y_i(n)$ at the $i^{th}$ input unit comprises a target signal component $x_i(n)$, a reverberation signal component $v_i(n)$, and an additive noise component $w_i(n)$.

7. A method according to claim 5 wherein the characteristics of said second noise signal component w is represented by a predetermined inter input unit covariance matrix $C_W$ of the additive noise.

8. A method according to claim 1 wherein the characteristics of the target signal is represented by a look vector $\underline{d}(k,m)$ whose elements (i=1, 2, . . . , M) define the frequency and time dependent absolute acoustic transfer function from a target signal source to each of the M input units, or the relative acoustic transfer function from the $i^{th}$ input unit to a reference input unit.

9. A method according to claim 8 wherein said look vector $\underline{d}(km)$ and said noise covariance matrix $C_V(k,m)$, and optionally $C_W(k,m)$, are determined in an off-line procedure.

10. A method according to claim 1 further comprising:

estimating the inter input unit covariance matrix $\hat{C}_Y(k,m)$ of the noisy audio signal based on a number D of observations.

11. A method according to claim 10 wherein said maximum-likelihood estimates of the spectral variances $\lambda_X(k,m)$ and $\lambda_V(k,m)$ of the target signal component x and the noise signal component v, respectively, are derived from estimates of the inter-input unit covariance matrices $C_Y(k,m)$, $C_X(k,m)$, $C_V(k,m)$, and optionally $C_W(k,m)$, and the look vector $\underline{d}(k,m)$.

12. A method according to claim 1 wherein processing the noisy audio signal $y_i(n)$ based on the estimated spectral variances or scaled versions thereof to provide a noise reduced signal comprises:

applying beamforming to the noisy audio signal y(n) providing a beamformed signal and single channel post filtering to the beamformed signal to suppress noise signal components from a direction of the target signal and to provide the resulting noise reduced signal.

13. A method according to claim 12 wherein said beamforming is a target signal enhancement spatial filtering based on MVDR filtering applied to the time-frequency representation $Y_i(k,m)$ of the noisy audio signal $y_i(n)$ at an $i^{th}$ input unit, i=1, 2, . . . , M, to provide a beamformed signal wherein signal components from other directions than a direction of the target signal component are attenuated, while leaving signal components from the direction of the target signal component un-attenuated.

14. A method according to any one of claim 12 wherein gain values $g_{sc}(k,m)$ applied to the beamformed signal in the single channel post filtering process are based on the estimates of the spectral variances $\lambda_X(k,m)$ and $\lambda_V(k,m)$ of the target signal component x and the first noise signal component v, respectively.

15. A data processing system comprising:

a processor; and a memory having stored thereon program code which when executed cause the processor to perform the method of claim 1.

16. An audio processing system for processing a noisy audio signal y comprising a target signal component x and a first noise signal component v, the audio processing system comprising:

a multitude M of input units adapted to provide or to receive a time-frequency representation $Y_i(k,m)$ of the noisy audio signal $y_i(n)$ at an $i^{th}$ input unit, i=1, 2, . . . , M, where M is larger than or equal to two, in a number of frequency bands and a number of time instances, k being a frequency band index and m being a time index;

a look vector $\underline{d}(k,m)$, whose elements (i=1, 2, . . . , M) define the frequency and time dependent absolute acoustic transfer function from a target signal source to each of the M input units, or the relative acoustic transfer function form the ith input unit to a reference input unit, or an inter input covariance matrix $d(k,m)\cdot d(k,m)^H$, for the target signal component;

an inter-input unit covariance matrix $C_v(k,m)$ for the first noise signal component, or scaled versions thereof;

a covariance estimation unit for estimating an inter input unit covariance matrix $\hat{C}_Y(k,m)$, or a scaled version thereof, of the noisy audio signal based on the time-frequency representation $Y_i(k,m)$ of the noisy audio signals $y_i(n)$; and a spectral variance estimation unit for estimating spectral variances $\lambda_X(k,m)$ and $\lambda_V(k,m)$ or scaled versions thereof of the target signal component x and the first noise signal component v, respectively, based on said look vector d(k,m), said inter-input unit covariance matrix $C_v(k,m)$, and the covariance matrix $\hat{C}_Y(k,m)$ of the noisy audio signal, or scaled versions thereof, wherein said estimates of $\lambda_V$ and $\lambda_X$ are jointly optimal in maximum likelihood sense, jointly optimal being taken to mean that both of the spectral variance $\lambda_V$ and $\lambda_X$ are estimated in the same maximum likelihood estimation process, based on the statistical assumptions that a) the time-frequency representations $Y_i(k,m)$, $X_i(k,m)$, and $V_i(k,m)$ of respective signals $y_i(n)$, and signal components $x_i(n)$, and $v_i(n)$ are zero-mean, complex-valued Gaussian distributed, b) that each of them are statistically independent across time m and frequency k, and c) that $X_i(k,m)$ and $V_i(k,m)$ are uncorrelated; and a signal processing unit adapted to process the noisy audio signal $y_i(n)$ based on the estimated spectral variances or scaled versions thereof to provide a noise reduced signal.

17. An audio processing system according to claim 16 wherein the noisy audio signal y(n) comprises a target signal component x(n), a first noise signal component being a reverberation signal component v(n), and a second noise signal component being an additive noise signal component w(n), and wherein the audio processing system comprises a predetermined inter input unit covariance matrix $C_W$ of the additive noise.

18. An audio processing system according to claim 17 wherein the spectral variance estimation unit is configured to estimate spectral variances $\lambda_X(k,m)$ and $\lambda_V(k,m)$ or scaled versions thereof of the target signal component x and the first noise signal component v, respectively, based on said look vector d(k,m), said inter-input unit covariance matrix $C_v(k,m)$ of the first noise component, said inter-input unit covariance matrix $C_W(k,m)$ of the second noise component, and said covariance matrix $\hat{C}_Y(k,m)$ of the noisy audio signal, or scaled versions thereof, wherein said estimates of $\lambda_V$ and $\lambda_X$ are jointly optimal in maximum likelihood sense, based on the statistical assumptions that a) the time-frequency representations $Y_i(k,m)$, $X_i(k,m)$, $V_i(k,m)$, and $W_i(k,m)$ of respective signals $y_i(n)$, and signal components $x_i(n)$, $v_i(n)$, $w_i(n)$ are zero-mean, complex-valued Gaussian distributed, b) that each of them are statistically independent across time m and frequency k, and c) that $X_i(k,m)$, $V_i(k\ m)$ and $W_i(k,m)$ are mutually uncorrelated.

19. An audio processing system according to claim 16 further comprising:

one of a hearing aid, a headset, an earphone, and an ear protection device, or a combination thereof.

* * * * *